US012667751B2

(12) United States Patent
Sasano

(10) Patent No.: US 12,667,751 B2
(45) Date of Patent: Jun. 30, 2026

(54) HOOK-AND-HANDLE DEVICE

(71) Applicant: Kensui LLC, Sheridan, WY (US)

(72) Inventor: Remy Sasano, Osaka (JP)

( * ) Notice: Subject to any disclaimer, the term of this patent is extended or adjusted under 35 U.S.C. 154(b) by 115 days.

(21) Appl. No.: 18/180,537

(22) Filed: Mar. 8, 2023

(65) Prior Publication Data

US 2023/0302323 A1 Sep. 28, 2023

Related U.S. Application Data

(60) Provisional application No. 63/420,106, filed on Oct. 28, 2022, provisional application No. 63/323,088, filed on Mar. 24, 2022.

(51) Int. Cl.
*A63B 21/00* (2006.01)

(52) U.S. Cl.
CPC ..... *A63B 21/4035* (2015.10)

(58) Field of Classification Search
CPC .... A63B 21/4035; A45F 5/102; A45F 5/1026; A45F 5/1046
See application file for complete search history.

(56) References Cited

U.S. PATENT DOCUMENTS 3,520,570 A * 7/1970 Christopher ..... A47J 45/10 D9/434
3,799,416 A * 3/1974 Schmaltz ..... A47G 25/1457 294/142
D295,727 S * 5/1988 Clarke ..... D9/434
D358,094 S * 5/1995 DeGiacomo, Jr. ..... D9/434
5,441,323 A * 8/1995 Goddard ..... A45F 5/1026 294/166
D369,470 S * 5/1996 Suggs, Sr. ..... D3/315
D385,788 S * 11/1997 Risser ..... D9/434
D447,947 S * 9/2001 Nakagawa ..... D9/434
D463,127 S * 9/2002 Haertzen ..... D3/328
6,585,204 B1 * 7/2003 Haertzen ..... E06C 7/14 248/211
D520,362 S * 5/2006 Powell ..... D9/434
7,232,168 B2 * 6/2007 Orefice ..... A45F 5/02 294/142
D583,155 S * 12/2008 Melfi ..... D3/328
D629,301 S * 12/2010 Jarrell ..... A45F 5/1026 D9/434
8,136,856 B2 * 3/2012 Schwanbeck ..... B66C 1/34 294/82.1

(Continued)

FOREIGN PATENT DOCUMENTS

CA 2971845 A1 * 12/2018 ..... A63B 21/4035
JP H08257164 10/1996

*Primary Examiner* — Joshua T Kennedy
(74) *Attorney, Agent, or Firm* — Michael D. Eisenberg

(57) ABSTRACT

A gripper device for gripping a bar, the gripper device comprising a hook, a protective layer, and a handle. The hook has a first end and a second end, a first inner surface curving around a first axis and facing the first axis, and a first outer surface facing away from the first axis. The inner surface of the hook is shaped to partially curve around a bar parallel to the first axis and grip the bar. The protective layer coats the inner surface of the hook and is configured to contact the bar when the hook grips the bar. The handle is joined to the second end of the hook, such that the handle extends along a second axis located at a predetermined distance from the first axis and being at a first angle with the first.

18 Claims, 18 Drawing Sheets

(56) References Cited

U.S. PATENT DOCUMENTS

| | | | | |
|---|---|---|---|---|
| 8,267,841 | B1 * | 9/2012 | Allison | A63B 21/075 482/106 |
| D704,779 | S * | 5/2014 | Boatwright | D21/691 |
| 9,833,654 | B1 * | 12/2017 | Gant | A63B 21/4035 |
| 10,857,416 | B2 * | 12/2020 | Leipheimer | A63B 21/4035 |
| 11,925,828 | B2 * | 3/2024 | Inniss | A63B 21/4009 |
| D1,040,265 | S * | 8/2024 | Lv | D21/694 |
| 2004/0185989 | A1 | 9/2004 | Emick | |
| 2009/0203508 | A1 * | 8/2009 | Hauser | A63B 21/4049 482/139 |
| 2011/0173778 | A1 * | 7/2011 | Wales | B25G 3/20 16/426 |
| 2013/0244842 | A1 * | 9/2013 | Henley | A63B 21/072 482/106 |
| 2013/0303348 | A1 * | 11/2013 | Cardin | A63B 21/0724 482/139 |
| 2014/0024506 | A1 * | 1/2014 | Vixathep | A63B 21/0726 482/108 |
| 2019/0168063 | A1 * | 6/2019 | Kefauver | A63B 21/4035 |
| 2019/0351281 | A1 * | 11/2019 | Monarrez, Jr. | A63B 21/4035 |
| 2024/0189662 | A1 * | 6/2024 | Kachlany | A63B 23/14 |

* cited by examiner

HOOK-AND-HANDLE DEVICE

CROSS-REFERENCE TO RELATED APPLICATIONS

This application claims priority from U.S. Provisional Application Ser. No. 63/323,088 filed on Mar. 24, 2022, and from U.S. Provisional Application Ser. No. 63/420,106, filed on Oct. 28, 2022, both of which are hereby incorporated herein by reference in their respective in entirety.

TECHNICAL FIELD

This invention relates to exercising equipment, and more specifically (but not limited to) to exercising equipment for calisthenics, weight training, and physical fitness.

BACKGROUND OF THE INVENTION

In fitness equipment, most pull-up bars are straight and cannot be gripped by a user via a neutral grip (also called, Swiss grip or hammer grip). Most pull up bars can only be gripped via a supinated grip (also known as a chin-up) or a pronated grip (also known as a pull-up).

Neutral grip is considered the safest and strongest grip and is the preferred method for many people with wrist and shoulder issues. Similar issues exist with barbells to perform movements like rows and deadlifts. Although Swiss barbells exist, they are extremely rare and very expensive. Furthermore, certain exercises, such as deadlifts for example, are hard to perform with a Swiss barbell since they are too bulky.

BRIEF SUMMARY OF EMBODIMENTS OF THE INVENTION

An aim of the present of the present invention is to provide a device that enable the user to grip existing exercise equipment, such as pull-up bars or bar-bells, for example, with a Swiss grip or a grip that is not fully pronated or supinated.

Therefore, an aspect of some embodiments of the present invention relates to a gripper device for gripping a bar, the gripper device comprising a hook, a protective layer, and a handle. The hook has a first end and a second end, a first inner surface curving around a first axis and facing the first axis, and a first outer surface facing away from the first axis. The inner surface of the hook is shaped to partially curve around a bar parallel to the first axis and grip the bar. The protective layer coats the inner surface of the hook and is configured to contact the bar when the hook grips the bar. The handle is joined to the second end of the hook, such that the handle extends along a second axis located at a predetermined distance from the first axis and being at a first angle with the first axis.

In a variant, the first angle between the second axis and the first axis is larger than 0 degrees and smaller than or equal to about 90 degrees.

In another variant, the protective layer is elastic.

In yet another variant, the gripper device comprises a removable attachment having a hook shape and having a second inner surface and a second outer surface, the removable attachment being removable joinable to the first inner surface of the hook. The second outer surface is configured to face the first inner surface to hook. The second inner surface curves around a third axis at a second angle with the first axis and is configured to partially curve around a bar parallel to the third axis and grip the bar, such that the third axis is at a second angle with the second axis different than the first angle between the first axis and the second axis.

In a further variant, the handle comprises a palm supporting surface tilted with respect to an axis perpendicular to the first and extending from the first axis to the handle.

In some embodiments of the present invention, the handle is joined to the hook via a connective portion located between the hook and the handle.

In a variant, the connective portion and the hook are rotatable with respect to each other and are configured to be lockable at a plurality of orientations with respect to each other, such that the angle between the first axis and the second axis is adjustable.

In another variant, the gripper device includes a first rim, a second rim, and a pin. The first rim extends from the connective portion and has a plurality of first openings disposed around the first rim. The second rim extends from the hook and has second openings disposed around the second rim. The pin is configured to fit into the first openings and the second openings. The first rim is configured to fit within the second rim, or the second rim is configured to fit within the first rim, such that at least two of the first openings are aligned with two of the second openings at at least two different orientations, such that the pin is configured to traverse a first pair of openings and a second pair of openings, the first pair comprising one of the first openings and one of the second openings aligned therewith, and the second pair comprising a different one of the first openings and a different on of the second openings aligned therewith.

In yet another variant, the first rim and the second rim are cylindrical, the first openings are disposed circumferentially on a curved surface of the first rim, and the second openings are disposed circumferentially on a curved surface of the second rim.

In a variant, the handle is knurled.

In another variant, the handle has a non-uniform shape, in which a thickness of the handle changes along a longitudinal length of the handle.

Another aspect of some embodiments of the present invention relates to a kit of a pair of gripper devices for gripping a bar, the kit comprising a first gripper device and a second gripper device. Each of the gripper devices, comprises a hook, a protective layer, and a handle. The hook has a first end, a second end, a first inner surface curving around a first axis and facing the first axis, and a first outer surface facing away from the first axis, the first inner surface of the first hook being shaped to partially curve around a bar parallel to the first axis and grip the bar. The protective layer coats the first inner surface of the hook and is configured to contact the bar when the hook grips the bar. The handle joined to the second end of the hook, such that the first handle extends along a second axis located at a predetermined distance from the first axis and being at a first angle with the first axis.

In a variant the handles of the gripper devices are symmetrical to each other with respect to a central plane perpendicular to the bar and located at a midpoint between the gripper devices when the gripper devices grip the bar.

In another variant, the first angles are larger than 0 degrees and smaller than or equal to about 90 degrees.

In yet another variant, the kit includes two removable attachments, each having hook shape and having a second inner surface and a second outer surface, each removable attachment being removable joinable to the first inner surface of a respective hook. Each second outer surface is configured to face the first inner surface to hook. Each second inner surface curves around a respective third axis at a second angle with the first axis and is configured to partially curve around a bar parallel to the third axis and grip the bar, such that the third axis is at a second angle with the second axis different than the first angle between the first axis and the second axis.

In a further variant, each protective layer is elastic.

In yet a further variant, each handle comprises a respective palm supporting surfaces tilted with respect to an axis perpendicular to the first axis and extending from the first axis to the handle.

In a variant, each handle is joined to the respective hook via a respective connective portion located between the hook and the handle.

In another variant, each of the handles is knurled.

In yet another variant, each handle has a non-uniform shape, in which a thickness of each handle changes along a longitudinal length of the handle.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein illustrate various embodiments of the invention from different viewing angles. Although the accompanying descriptive text may refer to such views as "top," "bottom" or "side" views, such references are merely descriptive and do not imply or require that the invention be implemented or used in a particular spatial orientation unless explicitly stated otherwise.

FIG. 7-10 illustrate an adjustable gripper device in different configurations, each configuration corresponding to a different orientation of the handle with respect to the hook, according to some embodiments of the present invention;

FIG. 36 illustrates a pair of symmetrical removable attachments for two gripping devices, according to some embodiments of the present invention.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

From time-to-time, the present invention is described herein in terms of example environments. Description in terms of these environments is provided to allow the various features and embodiments of the invention to be portrayed in the context of an exemplary application. After reading this description, it will become apparent to one of ordinary skill in the art how the invention can be implemented in different and alternative environments.

Unless defined otherwise, all technical and scientific terms used herein have the same meaning as is commonly understood by one of ordinary skill in the art to which this invention belongs. All patents, applications, published applications and other publications referred to herein are incorporated by reference in their entirety. If a definition set forth in this section is contrary to or otherwise inconsistent with a definition set forth in applications, published applications and other publications that are herein incorporated by reference, the definition set forth in this document prevails over the definition that is incorporated herein by reference.

Figure 1:
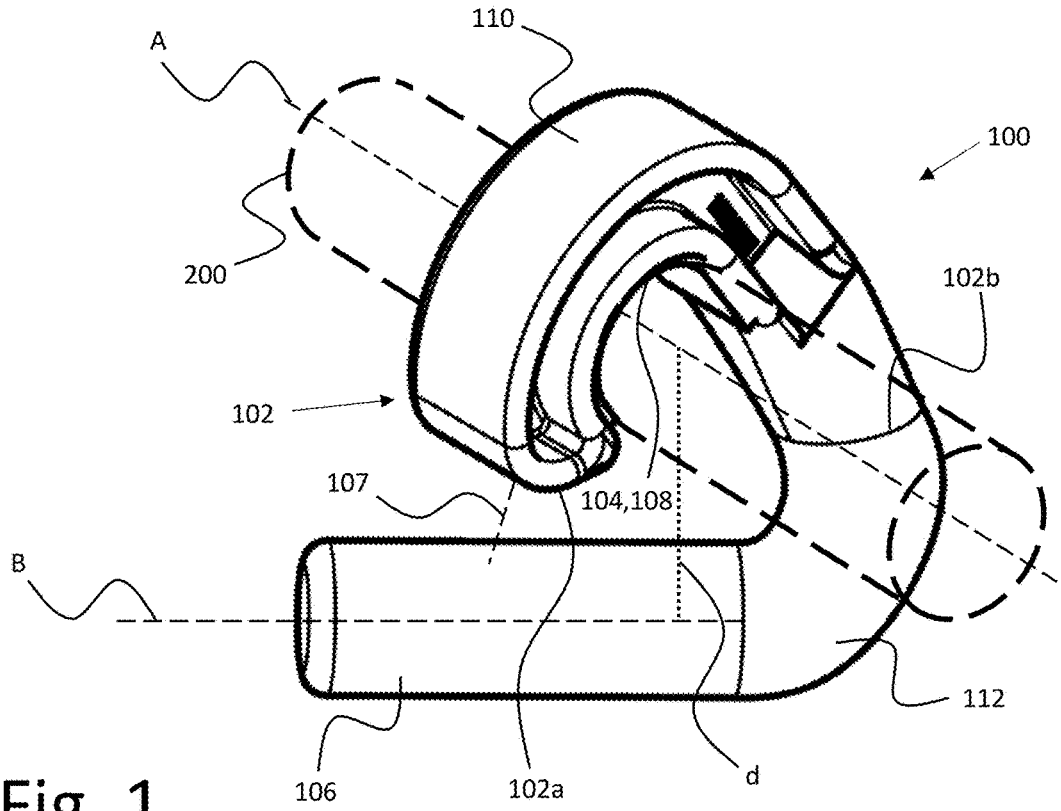
FIG. 1 is a perspective view of a gripper device, according to some embodiments of the present invention.
Figure 2:
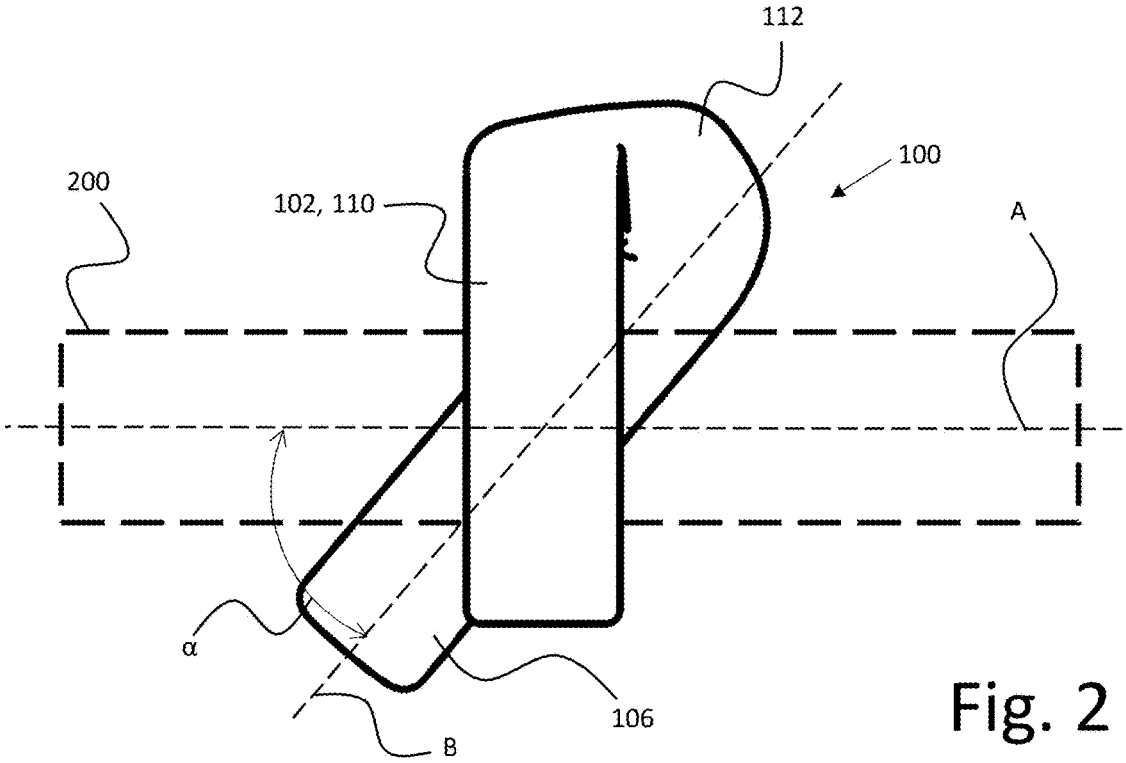
FIG. 2 is a top view of the gripper device of FIG. 1, according to some embodiments of the present invention.

Referring now to the drawings, FIG. 1 is a perspective view of a gripper device, according to some embodiments of the present invention. FIG. 2 is a top view of the gripper device of FIG. 1, according to some embodiments of the present invention.

The gripper device 100 includes a hook 102, a protective layer, 104, and a handle 106. The hook 102 has a first end 102*a* and a second end 102*b*, an inner surface 108 and an outer surface 110. The inner surface 108 is curving around a first axis and facing the first axis A, while the outer surface 110 faces away from the first axis A, The inner surface 108 is shaped to partially curve around a bar 200, parallel to the first axis A and grip the bar 200. The bar A may overlap the first axis A Different hooks may be provided with different curvatures or shapes, each curvature or shape adapted to grip bars of different weights, shapes, and sizes.

Figure 18:
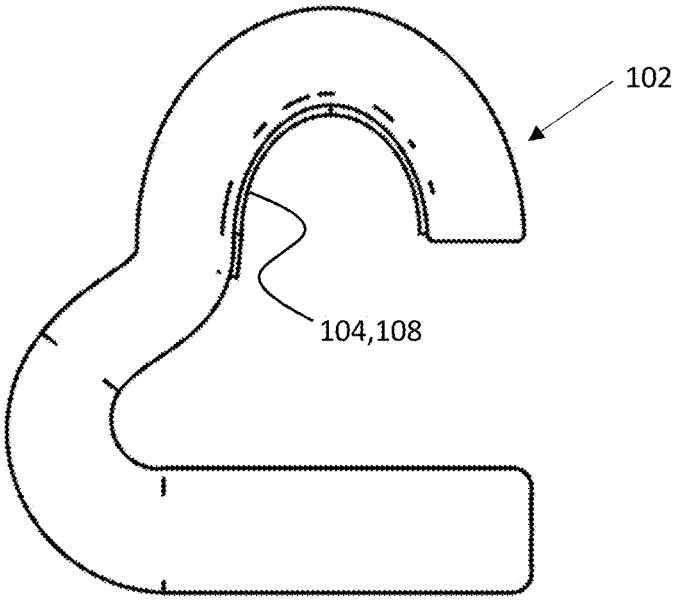
FIG. 18 is a side view of a gripper device having a hook with a side cross-sectional shape of an arc of an ellipse, according to some embodiments, of the present invention.
Figure 19A:
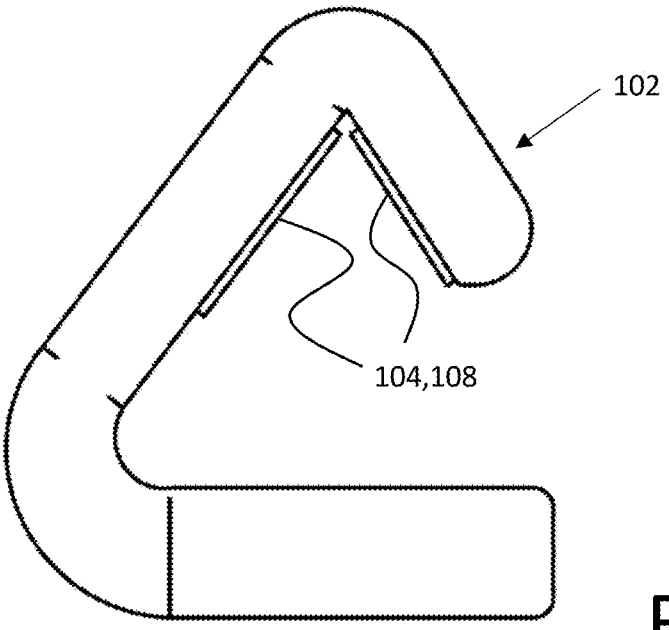
FIGS. 19*a* and 19*b* are a side view of a gripper device having a hook with a side cross-sectional shape of a portion of a polygon, according to some embodiments, of the present invention.
Figure 19B:
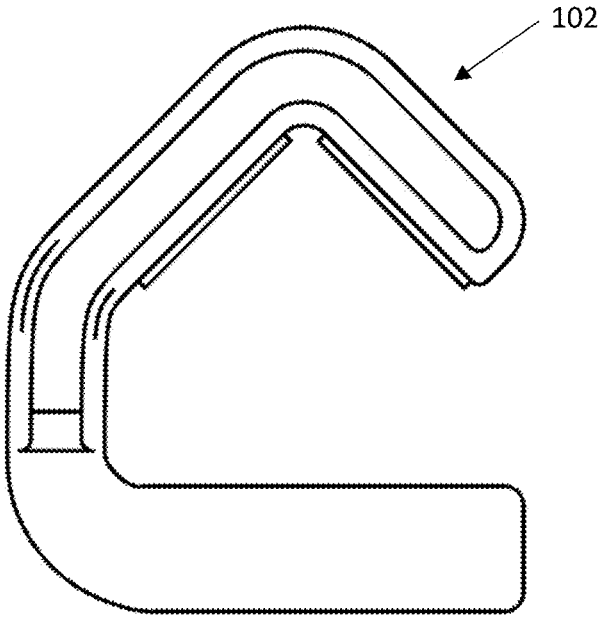

The inner surface 108 of the hook 102 may be shaped like an arc of a circle (as shown in FIG. 1), as an arc of an ellipse (as shown in the example of FIG. 18), a different type of curve, or a portion of a polygon—such as a triangle, for example (as shown in the example of FIG. 19). The shape of the inner surface 108 of the hook can be chosen to fit a plurality of bars. The inventor has found that the elliptical and triangular shapes have the benefit of being able to better accommodate a larger range of bars (for example, bars having a thickness of up to 50 mm). It should be noted that the scope of the present invention extends to hooks having any shape configured to extend around a bar.

Figure 3:
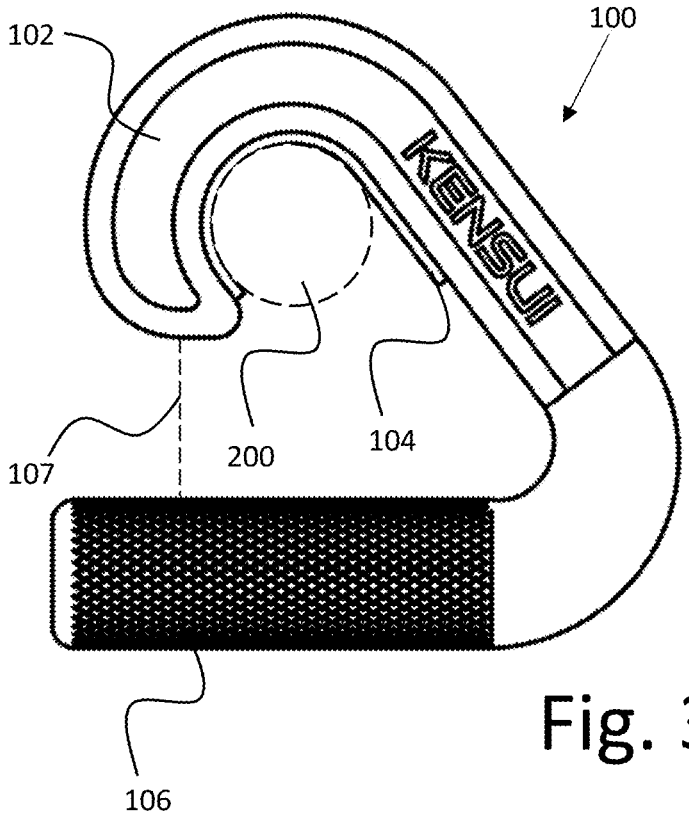
FIG. 3 is a side view of a gripper device having a handle which is aligned with the hook, according to some embodiments of the present invention.

The protective layer 104 coats the inner surface 108 of the hook 102 and is configured to contact the bar 200 when the hook 102 contacts the bar 200. The protective layer 104 is designed prevent damaging the bar and the gripper device. Furthermore, the protective layer 104 may also increase friction between the gripper device 100 and the bar 200, thereby decreasing or preventing slippage of the gripper device 100 on the bar 200. In some embodiments of the present invention the protective layer 104 is made of an elastic material. Optionally, the elastic material includes rubber. A clearer view of the protective layer 104 is shown in FIG. 3.

The handle 106 is joined to the second end 102*b* of the hook 102. In some embodiments of the present invention, a gap 107 is present between the first end 102*a* of the hook 102 and the end of the of handle 106 which is not joined to the hook. In this manner, the gripping device can be moved to receive the bar 200 via the gap 107 and then moved to move the bar into the hook, so that the hook grips the bar.

The handle 106 extends along a second axis B located at a predetermined distance from d the first axis A and disposed at an angle $\alpha$ with the first axis A. The angle $\alpha$ indicates the orientation of the handle 106 with respect to the bar 200 when the gripper device 100 gripper device. When the angle $\alpha$ is 90 degrees, the user's grip on the bar via the gripper device is neutral. When the angle $\alpha$ is 0 degrees, the user's grip on the bar via the gripper device is either pronated or supinated. In some embodiments the axes A and B are parts of planes parallel to each other and never touch. The angle $\alpha$ may be any fixed angle. In one non-limiting examples, the angle $\alpha$ is about 90 degrees (±10 degrees), so that the gripper device provides a full neutral grip. In other non-limiting examples, the angle $\alpha$ is larger than 0 degrees and smaller than 90 degrees, for example, about 30 degrees (±5 degrees), about 45, degrees (±5 degrees), or about 60 degrees (±7 degrees). At these angles, the grip is not fully neutral, but is not a zero-degree grip where the hand of the extends parallel to the bar. The handle 106 may be knurled, to enhance the user's grip on the handle. The hook 102 extends away from the handle at an acute angle.

Figure 20:
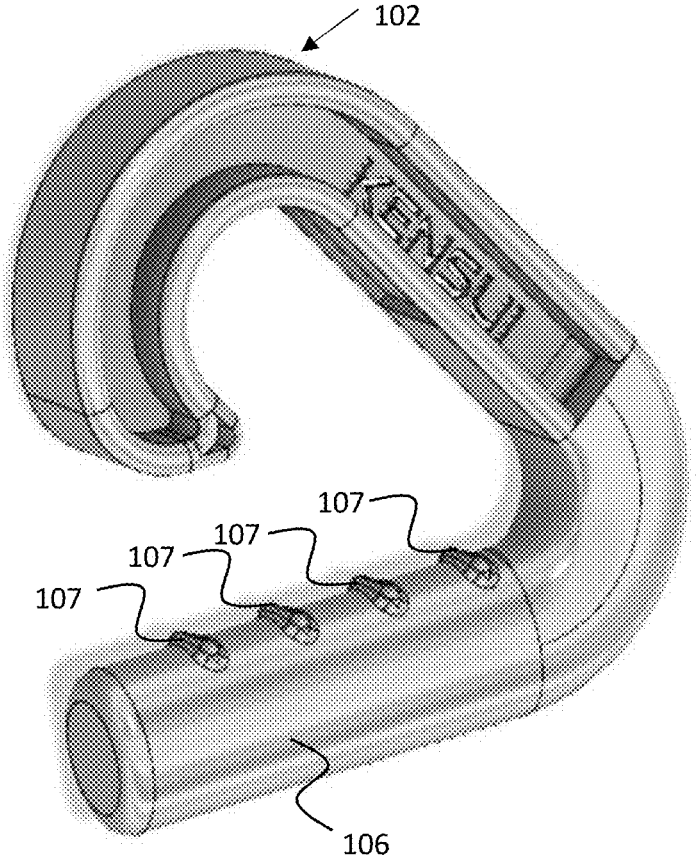
FIG. 20 illustrates a gripper device having an ergonomic handle, according to some embodiments, of the present invention.

In some embodiments of the present invention, the handle 106 may include an elastic covering configured to provide higher friction when gripped by a user, to enhance the user's grip on the handle. In some embodiments of the present invention, the handle 106 may have an ergonomic shape, with spaced-apart extensions 107 extending from a section of the handle 106 which faces the hook 102, as seen in the example of FIG. 20. The spacing between any two successive extensions is chosen to accommodate a finger of a user.

In some embodiments of the present invention, the handle is removably attached to the hook, so that differently-shaped handles can be connected to different-shaped hooks to yield a variety of gripping devices.

In use, the gripper device 100 grips a bar 200 (such as a bar of a barbell, a Smith bar, or a pull-up bar). A user holds the handle 106 and performs the exercise with the bar (by pulling the bar or pulling the user's body towards the bar). Because the user does not hold the bar 200 directly, and due to the angle $\alpha$ of the handle 106 with respect to the bar, the user's wrist is either at neutral grip or at a near-neutral grip.

The hook 102 and the handle 106 are rigid, so that the gripper device 100 does not to bend under stress exercised by a user pulling the user's body towards the bar while holding the handle 106 or by a user lifting the bar via the gripper device 100. The hook 102 and the handle 106 may include any rigid material, such as a hard plastic (e.g., hard nylon) or steel, for example. In some embodiments of the present invention, the hook and the handle are integral with each other.

In some embodiments of the present invention, the handle 106 is joined to the hook 102 via a connective portion 112 located between the hook 102 and the handle 106. The hook 102, the handle 106, and the connective portion 112 are rigid, so that the gripper device 100 does not to bend under stress exercised by a user pulling the user's body towards the bar while holding the handle 106 or by a user lifting the bar via the gripper device 100. The hook 102, the handle 106, and the connective portion 112 may include any rigid material, such as a hard plastic (e.g., hard nylon) or steel, for example. In some embodiments of the present invention, the hook, the handle, and connective portion are integral with each other.

Figure 4:
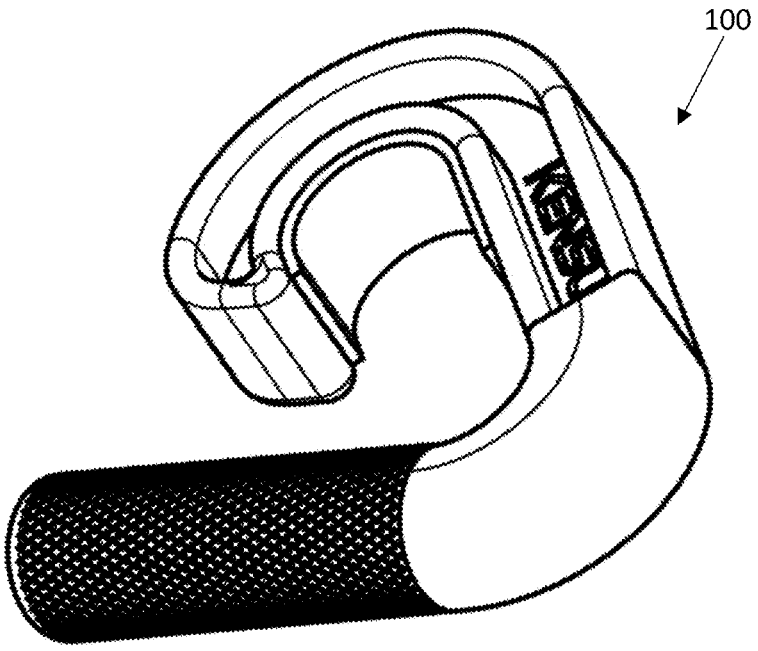
FIG. 4 is a perspective view of the gripper device of FIG. 3, according to some embodiments of the present invention.

FIG. 3 is a side view of a gripper device having a handle which is aligned with the hook, according to some embodiments of the present invention. FIG. 4 is a perspective view of the gripper device of FIG. 3, according to some embodiments of the present invention.

In the non-limiting example of FIGS. 3 and 4, the hook 102 and the handle 106 are aligned with each other. In other words, the handle 106 is perpendicular to axis A defined by the inner surface of the hook. The handle is thus perpendicular to the bar 200 while the gripper device 100 grips the bar 200. Therefore, the angle $\alpha$ shown in FIG. 2 is about 90 degrees (±10 degrees). In this manner, the user can hold the handle 106 and be in a full neutral grip during the exercise.

Figure 5:
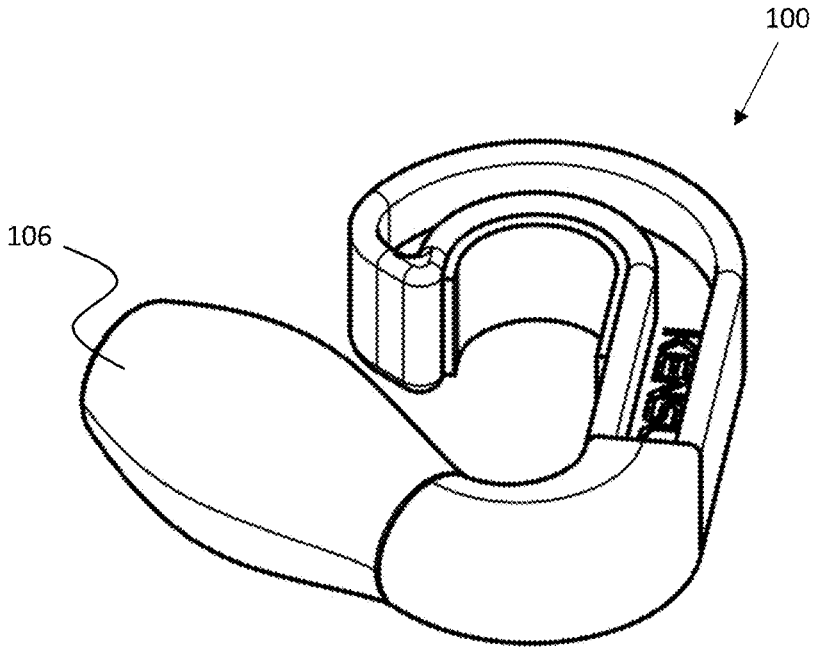
FIG. 5 is a perspective view of a gripper device having a handle that has a bulbous shape, according to some embodiments of the present invention.

FIG. 5 is a perspective view of a gripper device 100 having a handle that has a non-uniform shape, according to some embodiments of the present invention. The handle may have a thickness that changes along the longitudinal length of the handle. In some embodiments of the present invention, the handle is bulbous, being thickest in around the middle of the handle and less thick at the ends. The bulbous shape of handle 106 may enhance the grip.

Figure 6A:
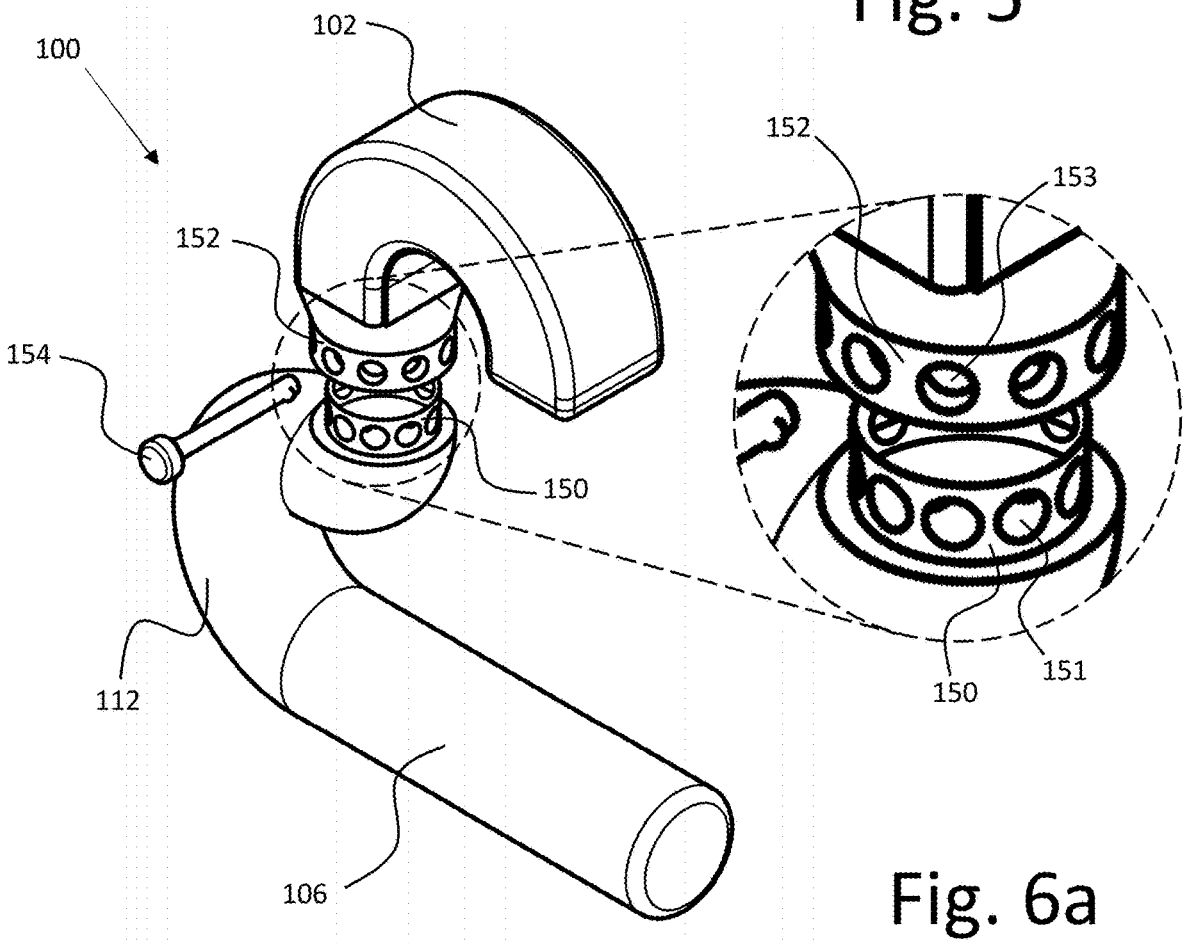
FIG. 6*a* is an exploded view of an adjustable gripper device, according to some embodiments of the present invention.
Figure 6B:
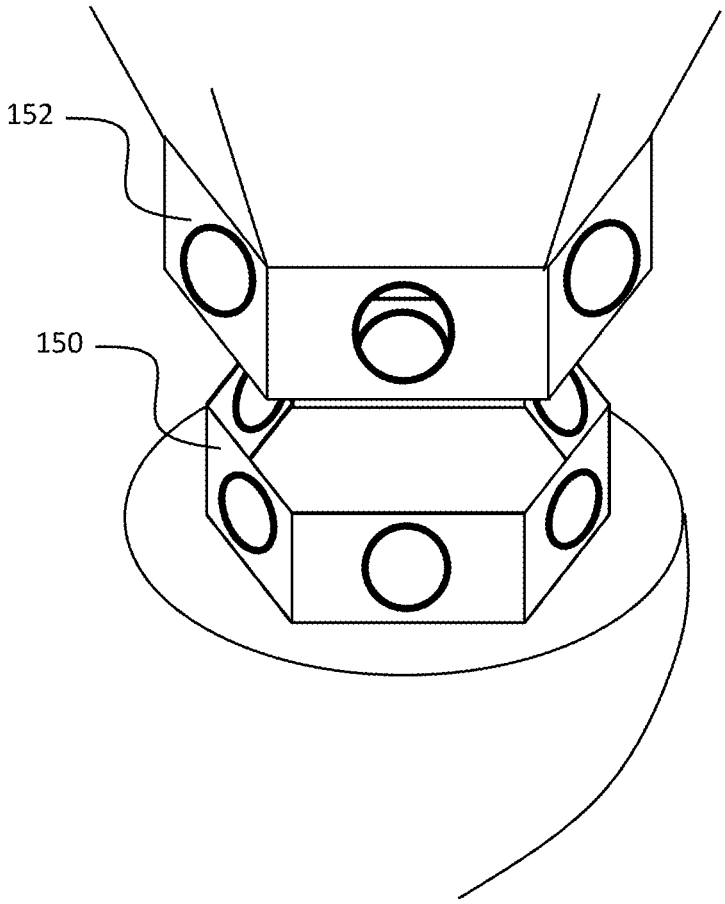
FIG. 6*b* shows a detail of an adjustable gripper device having rims with polygonal cross sections, according to some embodiments of the present invention.

FIG. 6*a* is an exploded view of an adjustable gripper device, according to some embodiments of the present invention. FIG. 6*b* shows a detail of an adjustable gripper device having rims with polygonal cross sections, according to some embodiments of the present invention. FIG. 7-10 illustrate an adjustable gripper device in different configurations, each configuration corresponding to a different orientation of the handle with respect to the hook, according to some embodiments of the present invention.

The connective portion 112 may be adjustable, so as to enable rotation of the handle 106 with respect to the hook 110, so as to change the angle α between the axes A and B. In this manner, the user may turn the gripper device before performing an exercise and thereby modify an exercise to the user's advantage, such as to prevent injury, increase range of motion, increase exercise variation, enhance grip, and increases mind-muscle connection, for example.

In an example of an adjustable gripper device, the connective 112 portion (which is fixedly joined to the handle 106) and the hook 110 are rotatable with respect to each other and are configured to be lockable at a plurality of orientations with respect to each other, such that the angle α is adjustable.

In some embodiments of the present invention, the gripper device 100 includes a first rim 150, a second rim 152, and pin 154. The first rim 150 extends from the connective portion 112, and has a plurality of first openings 151 disposed around the first rim 150. The second rim 152 extends from the hook 102 and has second openings 153 disposed around the second rim 152. The pin 154 is configured to fit into the first openings 151 and the second openings 153.

The first rim 150 is configured to fit within the second rim 152, or the second rim 152 is configured to fit within the first rim 150, such that at least two of the first openings 151 are aligned with two of the second openings 153 at at least two different orientations of the hook 102 with respect to the connective portion 112 (or, of the hook 102 with respect to the handle 106). In this manner, the pin 154 is configured to traverse a first pair of openings and a second pair of openings, the first pair comprising one of the first openings and one of the second openings aligned therewith, and the second pair comprising a different one of the first openings and a different on of the second openings aligned therewith.

As the pin 154 enters the rims 150 and 152 via the first pair of aligned openings and exits the rims 150 and 152 from the second pair of aligned openings, the pin holds the first rim 150 and the second rim 152 together and therefore maintains the first hook 102 joined to the connective portion 112. In this manner, by rotating the hook 102 with respect to the connective portion 112 (while the pin 154 is outside the rims), the angle α0 can be changed.

In some embodiments of the present invention, as shown in FIG. 6*a*, the first rim 150 and the second rim 152 are cylindrical. The first openings 151 are disposed circumferentially on a curved surface of the first rim 150. The second openings 153 are disposed circumferentially on a curved surface of the second rim 152.

In some embodiments of the present invention, as shown in FIG. 6*b*, the rims 150 and 152 have matching polygonal cross sections.

Figure 7:
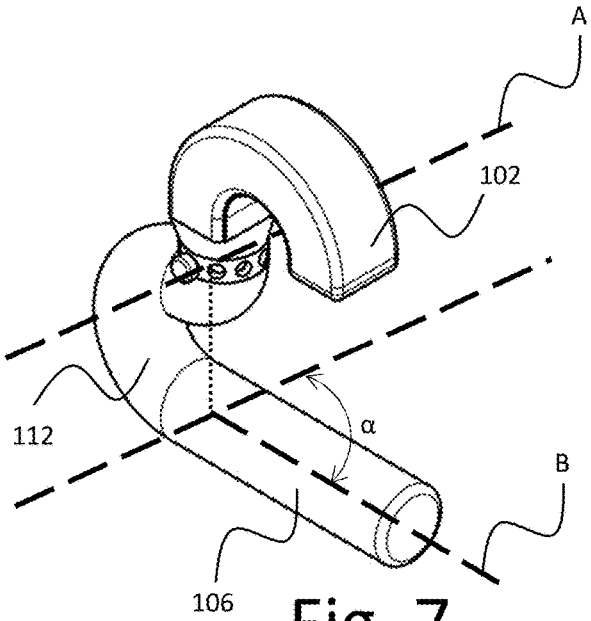
Figure 8:
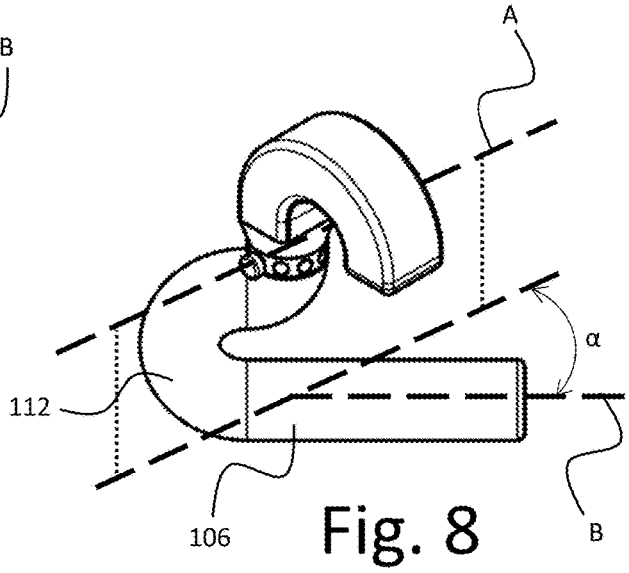
Figure 9:
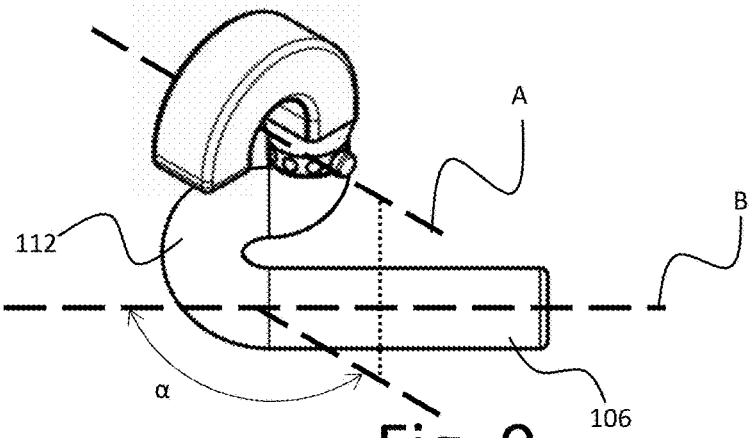

In the example of FIG. 7, the gripper device is adjusted so that the axes A and B are perpendicular to each other. In the example of FIG. 8, the gripper device is adjusted so that the axes A and B are at about 45 degrees with each other (α=45 degrees±5 degrees). In the example of FIG. 9, the gripper device is adjusted so that the axes A and B are at 135 degrees with each other (α=135 degrees±5 degrees). These are non-limiting configurations, and other angles between the axes A and B may be achieved.

FIG. 21-25 illustrate a gripping device 100 in which the handle 106 has a palm-supporting surface, according to some embodiments of the present invention.

Figure 21:
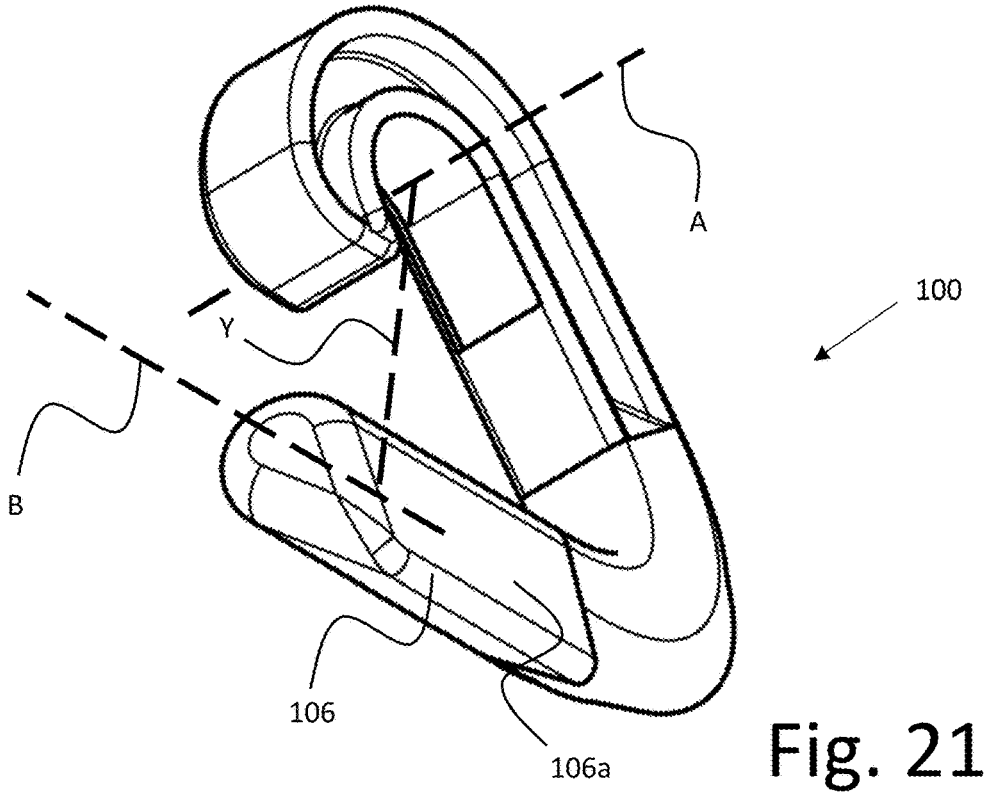
FIG. 21-25 illustrate a gripping device in which the handle has a palm-supporting shape, according to some embodiments of the present invention.
Figure 22:
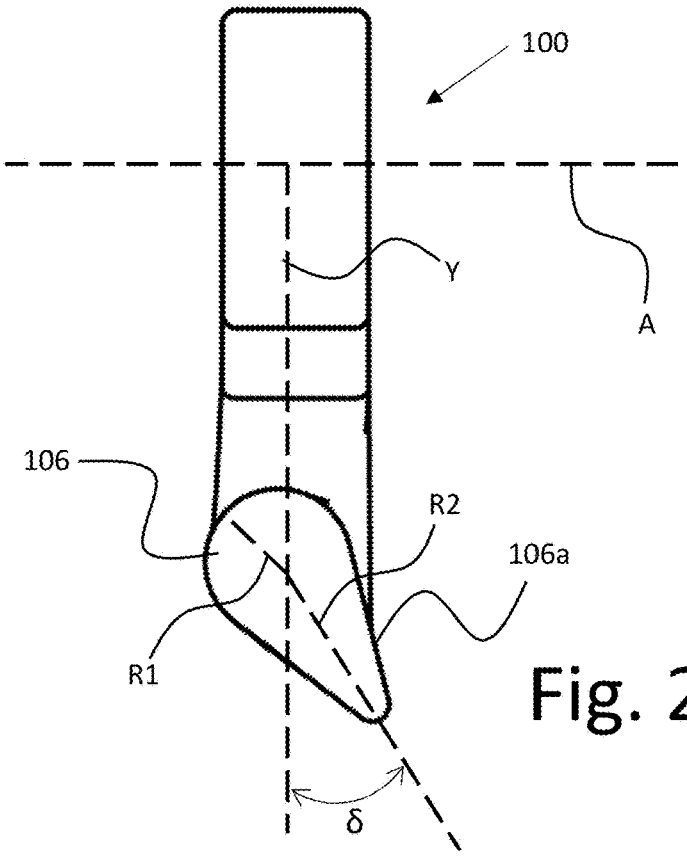
Figure 23:
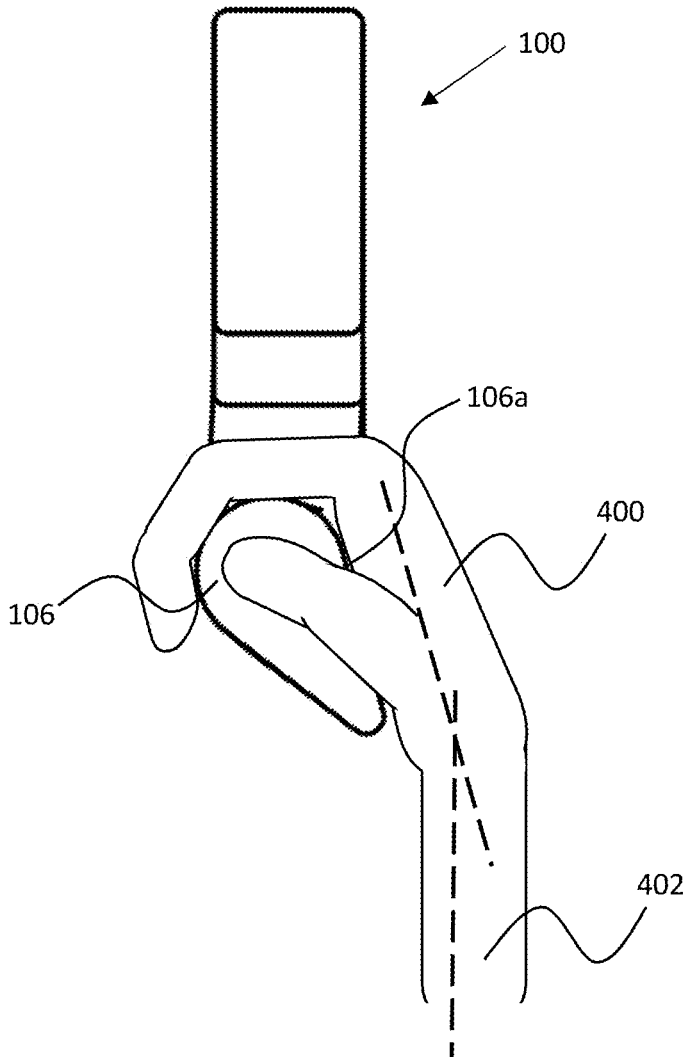
Figure 24:
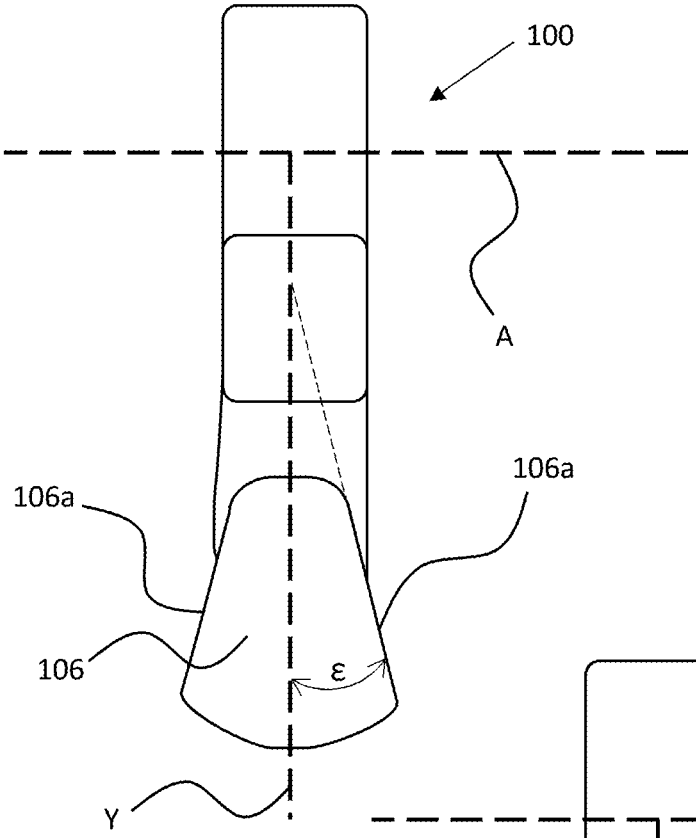
Figure 25:
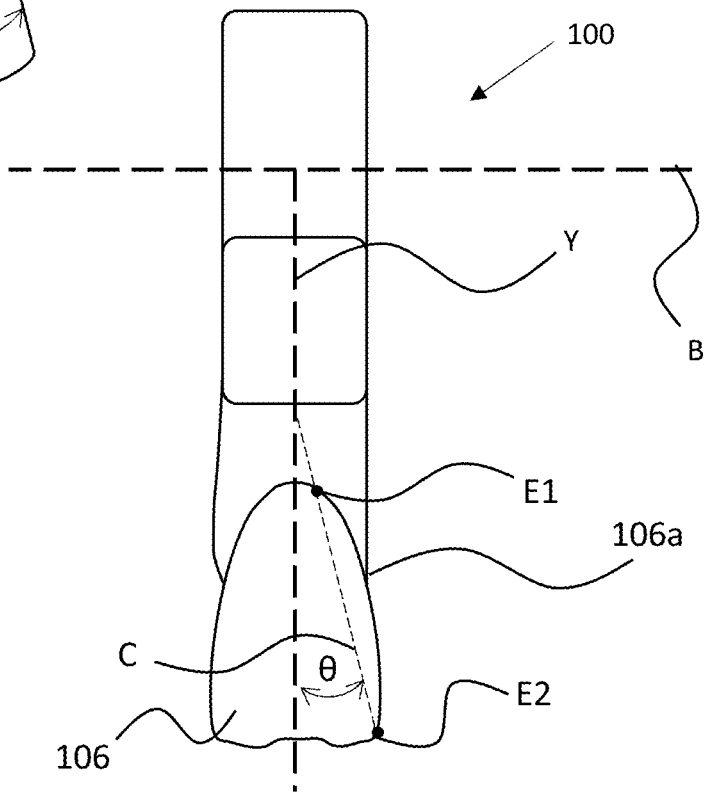

FIG. 21 is a perspective view of a gripping device 100 where the palm-supporting surface is a surface of a radial extension. FIG. 22 is a front view of the gripping device 100 of FIG. 21. FIG. 23 is a front view of the gripping device of FIG. 21 when the handle is held by a user's hand. FIG. 24 is a front view of a gripping device 100 in which the handle 106 has a trapezoidal shape with at least one tilted palm-supporting surfaces. FIG. 25 is a front view of a gripping device 100 in which the handle 106 has at least one tilted palm-supporting surface.

In the examples of FIGS. 21-23, the handle has a radial extension from the longitudinal axis thereof. The radial extension may be tilted at a third angle δ with respect to a third axis Y, which is perpendicular to the first axis A and extends from the first axis A to the second axis B. The tilt of the radial extension with respect to the third axis Y is such that the radial extension is not perpendicular the first axis A. The radial extension is elongated. In this manner a tilted surface 106*a* is created that faces to the side (away from the third axis Y) and upward (toward the first axis A). The surface 106*a* contacts the user's palm when the user's hand 400 grasps the handle. This improves the user's grip on the handle 106, for the following reasons: (1) surface area of contact between hand and handle is increased; and (2) if the palm-supporting surface is tilted, the wrist is kept in a partial form of flexion, as the palm of the hand 400 is tilted while the forearm 502 is substantially vertical during the exercise. With wrist flexion, the smaller finger muscles are no longer solely responsible for the grip. Rather, the larger and stronger wrist flexors are activated for effecting the grip. Moreover, wrist flexion helps activate the muscles surrounding the wrist flexors through a process called muscular irradiation, thereby enhancing strength in pulling movements.

In some embodiments of the present invention, the small radius R1 of the handle is between 28 mm and 34 mm, while the large radius R2 of the tilted radial extension is between 5 cm and 10 cm. In some embodiments of the present invention the angle δ is between 0 degrees and 30 degrees.

In the example of FIG. 24, the handle is not wholly tilted. Rather, the handle has at least one surface 106*a* that is tilted with respect to the axis Y and is not perpendicular to the axis A. The tilt c of the tilted surface may be between 5 and 30 degrees. In some embodiments of the present invention, the handle 106 has a trapezoidal shape with a tilted palm-supporting surface 106*a* on each lateral side. The tilts of the two titled palm-supporting surfaces 106*a* may be symmetrical with respect to the second the axis Y.

In the example of FIG. 25, the hand 106 includes at least one curved palm-supporting surface 106*a*. The curved palm-supporting surface 106*a* is still tilted with respect to the axis Y. The tilt θ is between the axis Y and an arc C connecting the edges E1 and E2 of the palm-supporting surface.

The surface 106*a* may be convex, concave, or may have convex portions and concave portions. In some embodiments of the present invention, the handle 106 may have two palm-supporting surfaces 106, each on a respective side of the axis Y. In some embodiments of the present invention, the handle 106 is symmetrical with respect to the axis Y.

Figure 10A:
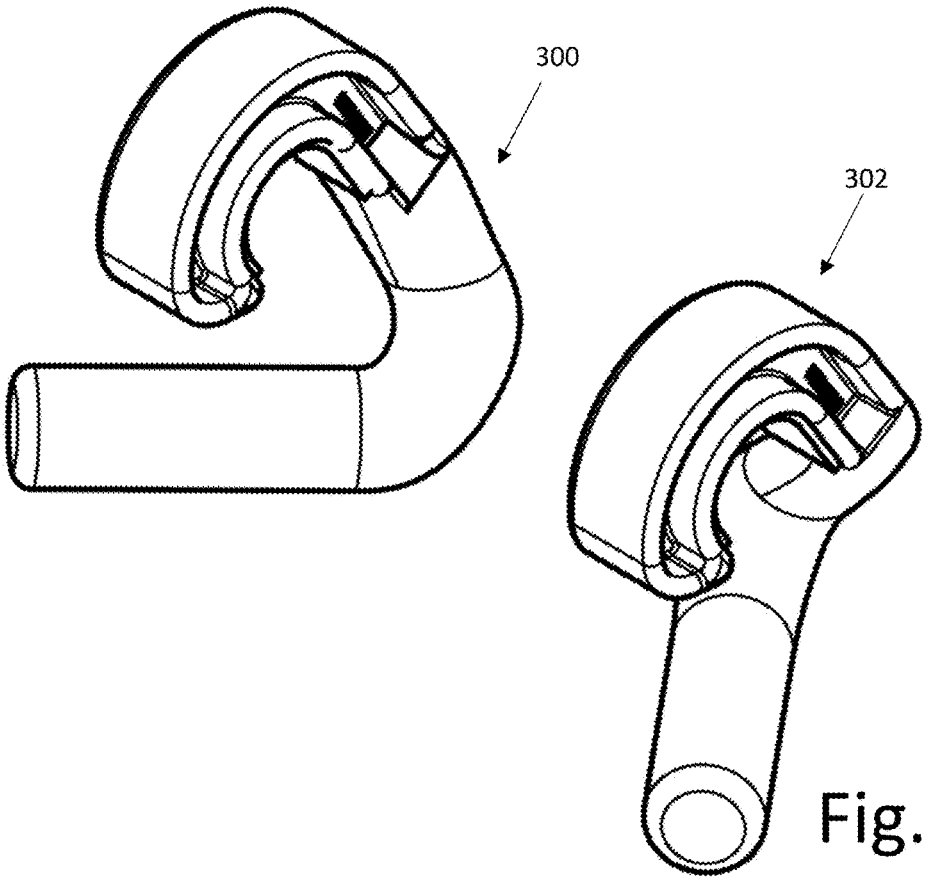
FIG. 10*a* is a perspective view of a kit having a pair of gripper devices, according to some embodiments of the present invention.
Figure 10B:
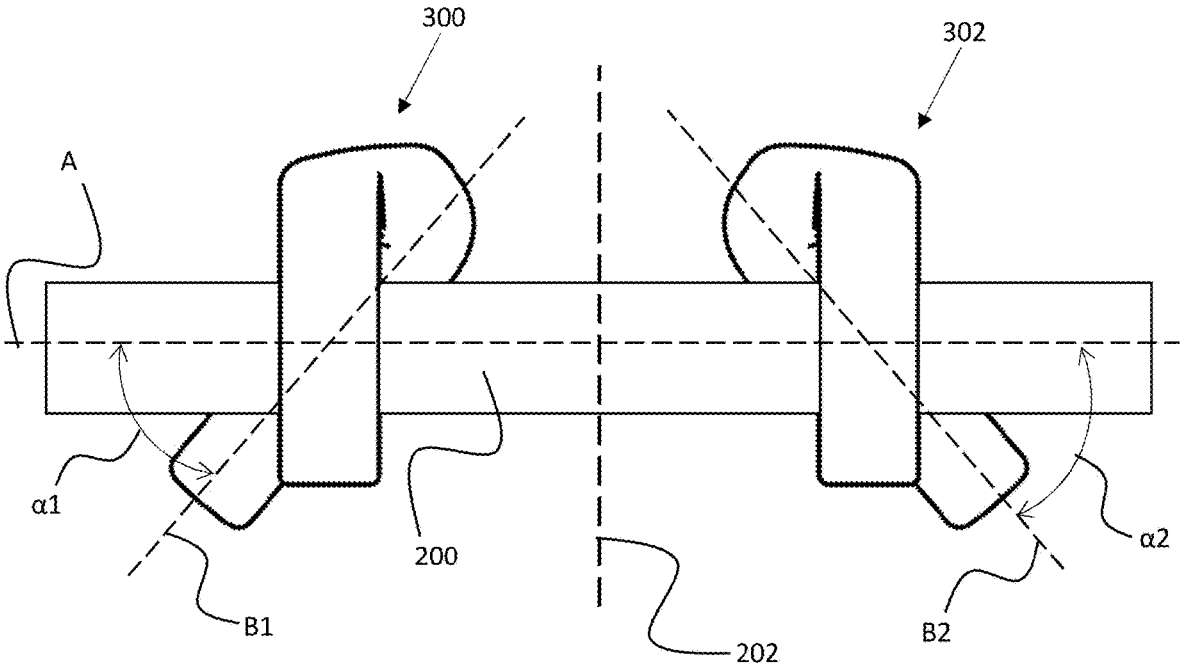
FIG. 10*b* is a top view of the gripper devices of the kit of FIG. 10*a* gripping a bar, according to some embodiments of the present invention.

FIG. 10*a* is a perspective view of a kit having a pair of gripper devices 300 and 302, according to some embodiments of the present invention. FIG. 10*b* is a top view of the gripper devices 300 of the kit gripping a bar 200.

The gripper devices 300 and 302 may have any features of the gripper devices described above and the handles and hooks may be at any angles with each other and with the bar 200, as explained above. The first gripper device 300 has an angle α1 between the axis A defined by the hook and the axis B1 of the handle (as explained above). The second gripper device 302 has an angle α2 between the axis A defined by the hook and the axis B2 of the handle (as explained above). In some embodiments of the present invention, the handles and hooks of the two gripping devices are symmetrical to each other with respect to a central plane 202 perpendicular to the bar 200 and located at a midpoint between the two gripper devices 300 and 302 when the gripper devices grip the bar 200. Therefore, to maintain the symmetry, $\alpha 1=-\alpha 2$.

FIGS. 26-38 relate to removable attachments for gripping devices, to change the orientation of the gripping device relative to the bar gripped by the gripping device.

Figure 26:
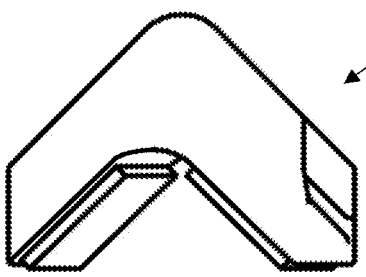
FIGS. 26-31 are different views of a removable attachment for a gripping device, according to some embodiments of the present invention.
Figure 27:
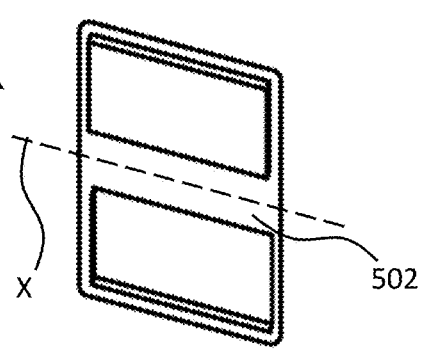
Figure 28:
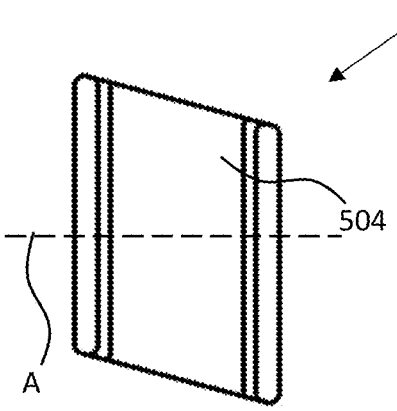
Figure 29:
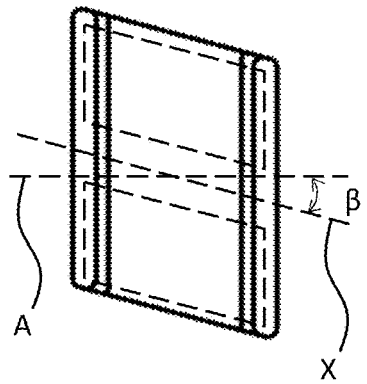
Figure 30:
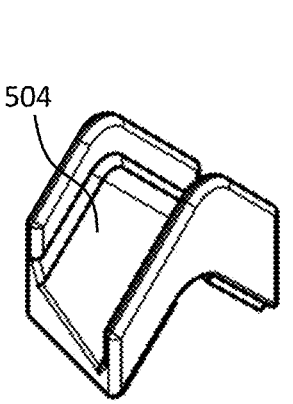
Figure 31:
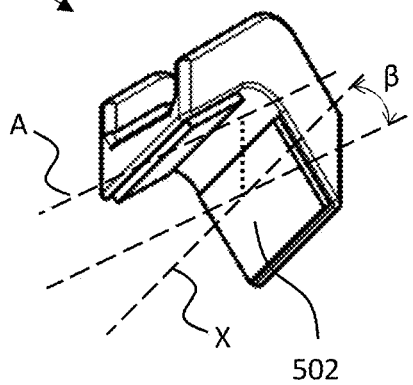
Figure 32:
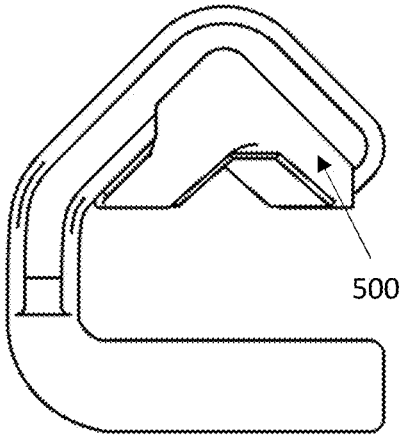
FIGS. 32-36 illustrate the removable attachment of FIGS. 26-31 joined to a gripping device, according some embodiments of the present invention.
Figure 33:
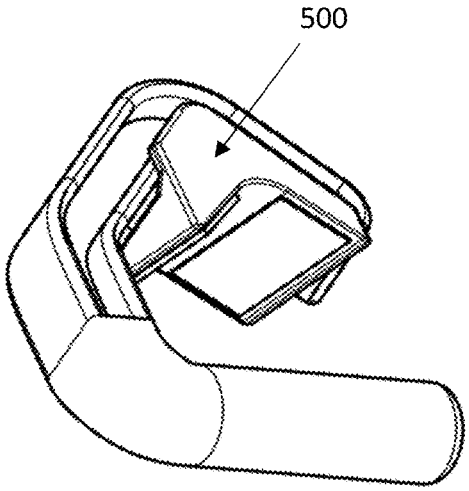
Figure 34:
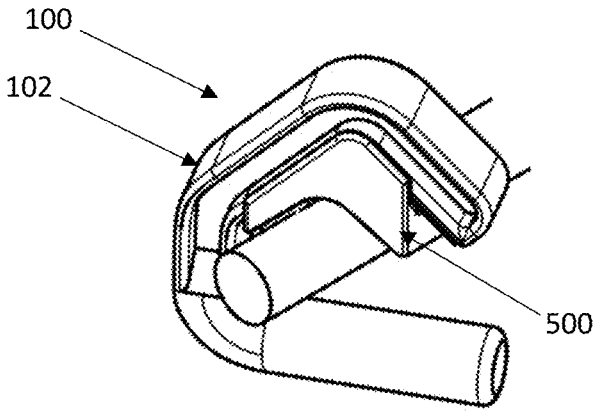
Figure 35:
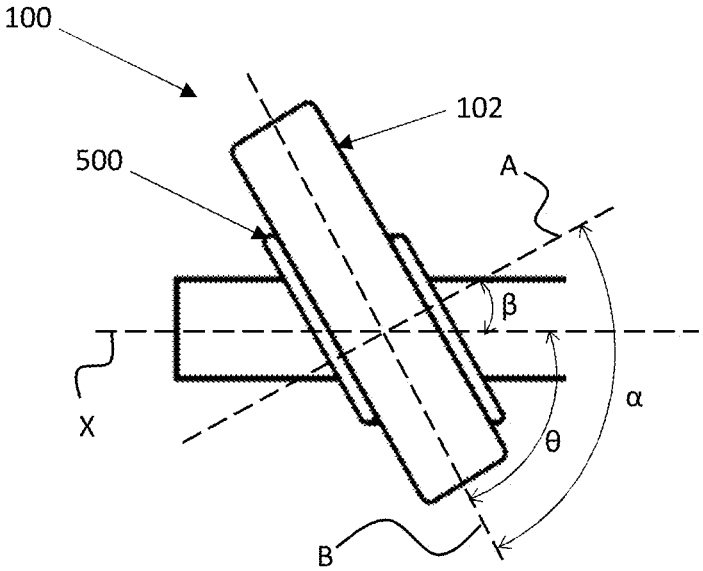

FIGS. 26-31 are different views of a removable attachment 500 for a gripping device, according to some embodiments of the present invention. FIG. 26 is a side view of the removable attachment 500. FIG. 27 is a bottom view of the removable attachment 500. FIG. 28 is a top view of the removable attachment 500. FIG. 29 is a top view superimposed with a bottom view of the removable attachment 500. FIGS. 30 and 31 are three-quarter perspective views of the removable attachment 500 from different viewpoints.

FIGS. 32-36 illustrate the removable attachment 500 of FIGS. 26-31 joined to the hook 102 of the gripping device 100, according to some embodiments of the present invention.

The removable attachment 500 has a hook shape and has a second inner surface 502 and a second outer surface 504, and is removably joinable to the inner surface 108 of the hook 102 (as shown in FIG. 1). The second outer surface 504 is shaped to face to the first inner surface to hook when joined to the hook. In some embodiments of the present invention, the second outer surface 504 is shaped to conform to the inner surface 108 of the hook 102 (as shown in FIG. 1). The second inner surface 502 curves around an axis X at a second angle β with the first axis A defined by the inner surface 108 of the hook 102 (as shown in FIG. 1), and is configured to partially curve around a bar parallel to the axis X and grip the bar 200, such that the axis X is at an angle θ with the second axis B different than the first angle α between the first axis A and the second axis B. In this manner, by joining he removable attachment 500 to the hook enables the gripper device 100 to be joined to the bar at an orientation different than the orientation the gripping device would have if joined to the bar with the removable attachment 500 removed. Thus, the same gripper device 100 enables the user to have differently-angled grips on the bar and to choose different grips as desired, by joining the removable attachment to the hook or removing the removable attachment from the hook.

In some embodiments of the present invention, the removable attachment 500 includes side wings 605 extending laterally to the second outer surface 504. The side wings 506 are configured to grip the hook 102 to so as to join the removable attachment to the hook 102.

Figure 36:
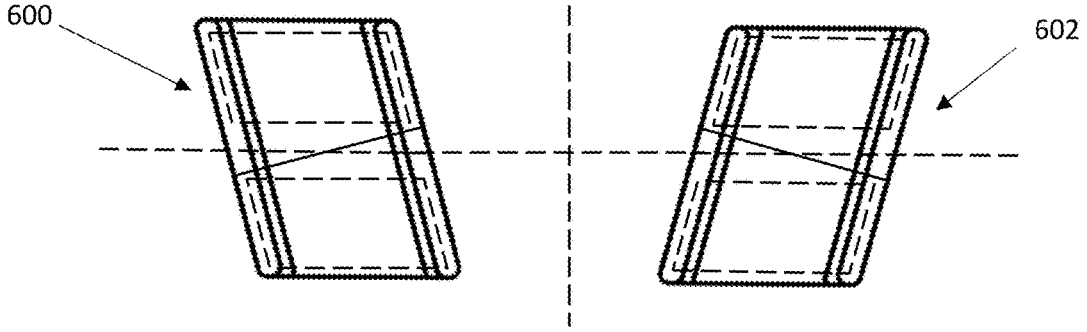
Figure 37:
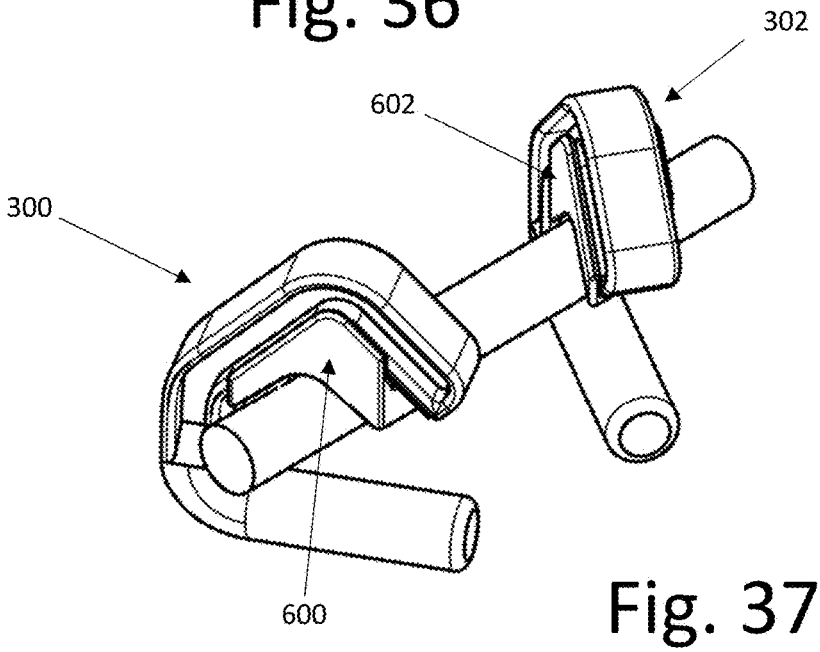
FIGS. 37-38 illustrate the pair of symmetrical removable attachments joined to two gripping devices, according to some embodiments of the present invention.
Figure 38:
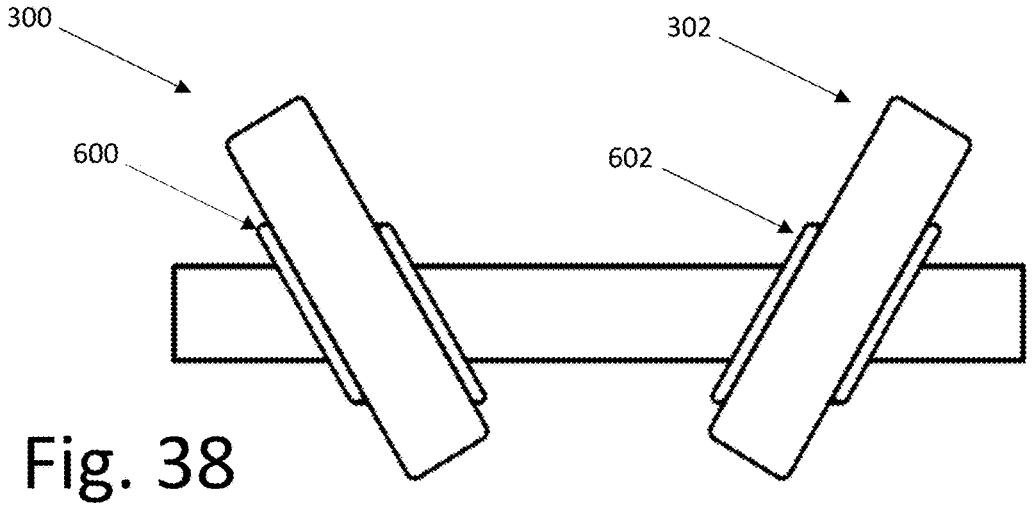

FIG. 36 illustrates a pair of symmetrical removable attachments for two gripping devices, according to some embodiments of the present invention. FIGS. 37-38 illustrate the pair of symmetrical removable attachments joined to two gripping devices, according to some embodiments of the present invention. FIG. 37 is a perspective view. FIG. 38 is a top view.

In some embodiments of the present invention, when two gripper devices 300 and 302 are provided, respective removable attachments 600 and 602 are also provided, each as part of a respective gripper device. The removable attachments 600 and 602 are similar to the removable attachment 500 described above.

When the gripper devices are symmetrical with respect to each other with respect to a plane (as explained above), the two removable attachments 600 and 602 may also be symmetrical to each other with respect to the same plane. In this manner the orientations of the handles 106 with respect to the bar 200 are symmetrical when the attachments 600 and 602 are joined to the hooks of the respective gripper devices.

FIGS. 11-17 are self-evident and illustrate uses of one or more gripper devices as described above with a plurality of types of bars for a plurality of exercise types. It should be noted that FIGS. 11-17 are non-limiting examples, and that the use of the gripper devices may extend to more types of bars and exercises.

Figure 11:
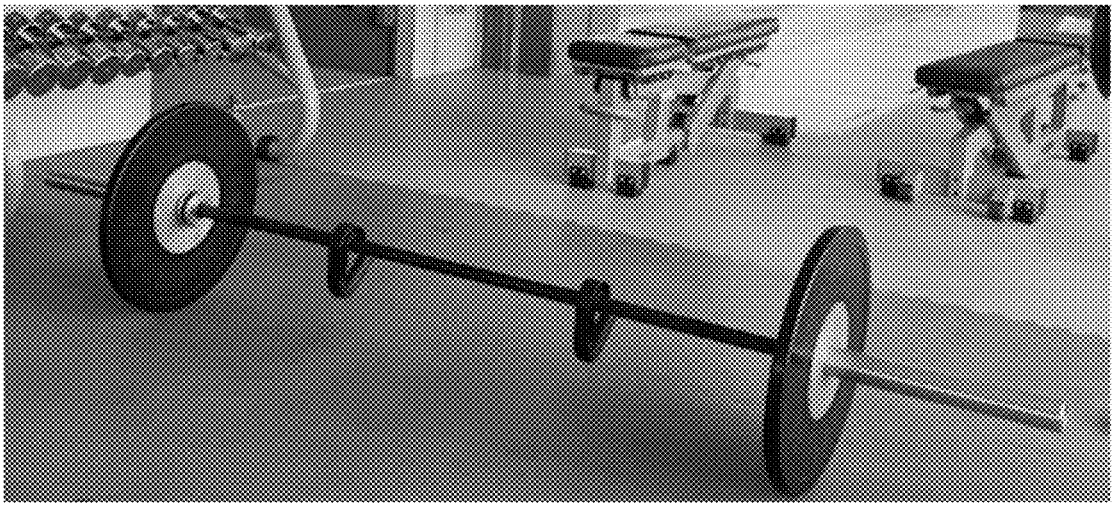
FIG. 11 illustrates a pair of gripper devices of the present invention gripping the bar of a barbell.
Figure 12:
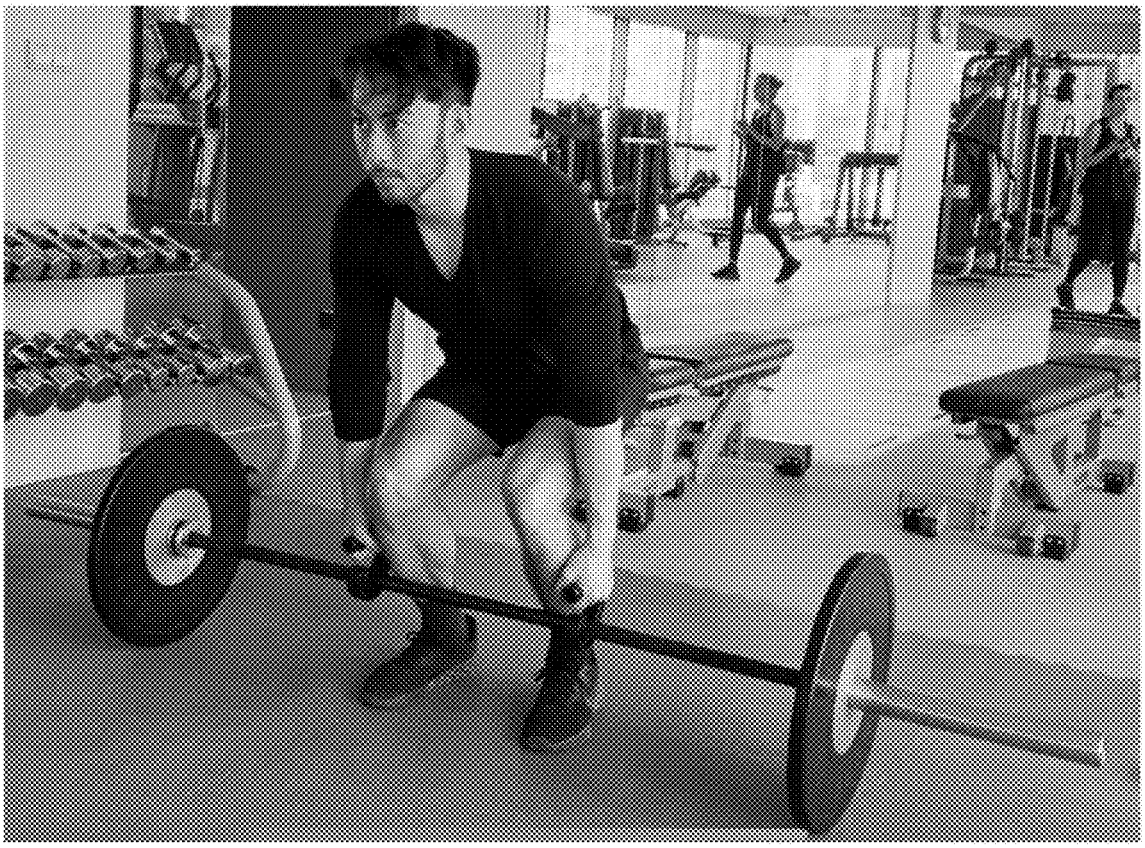
FIG. 12 illustrates a user using the pair of gripper devices of the present invention to lift the barbell in a deadlift exercise, in a neutral grip.

FIG. 11 illustrates a pair of gripper devices of the present invention gripping the bar of a barbell. FIG. 12 illustrates a user using the pair of gripper devices of the present invention to lift the barbell in a deadlift exercise, in a neutral grip.

Figure 13:
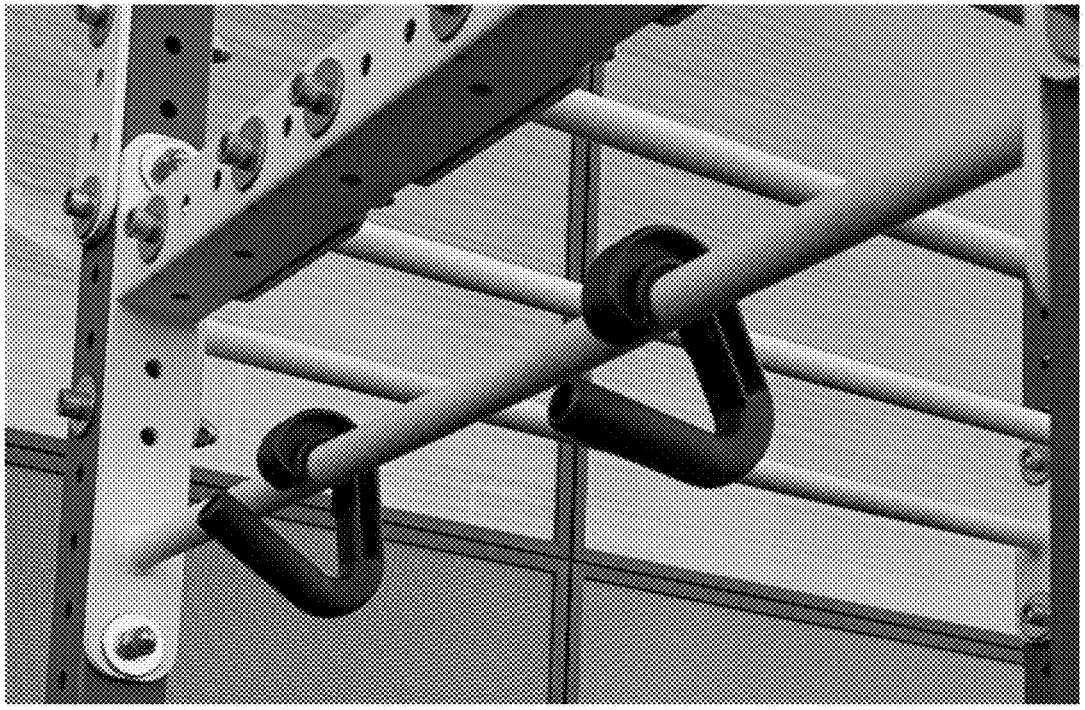
FIG. 13 illustrates a pair of gripper devices of the present invention gripping a pull-up bar.
Figure 14:
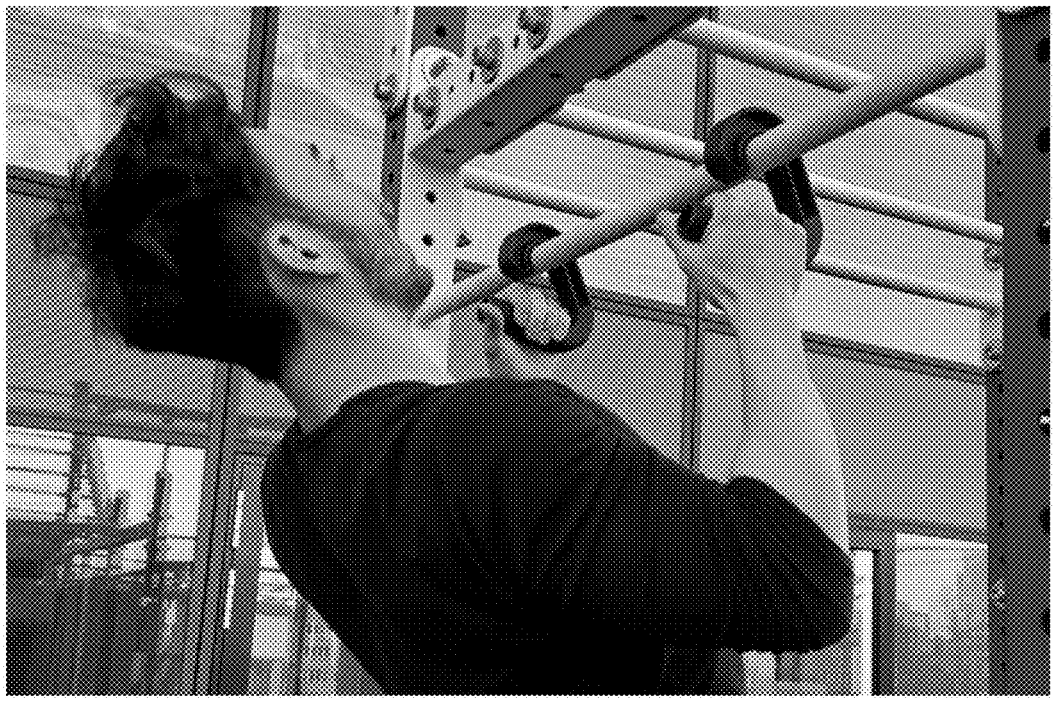
FIG. 14 illustrates a user performing a pull-up exercise in a neutral grip by holding the gripper devices gripping the pull-up bar.
Figure 15:
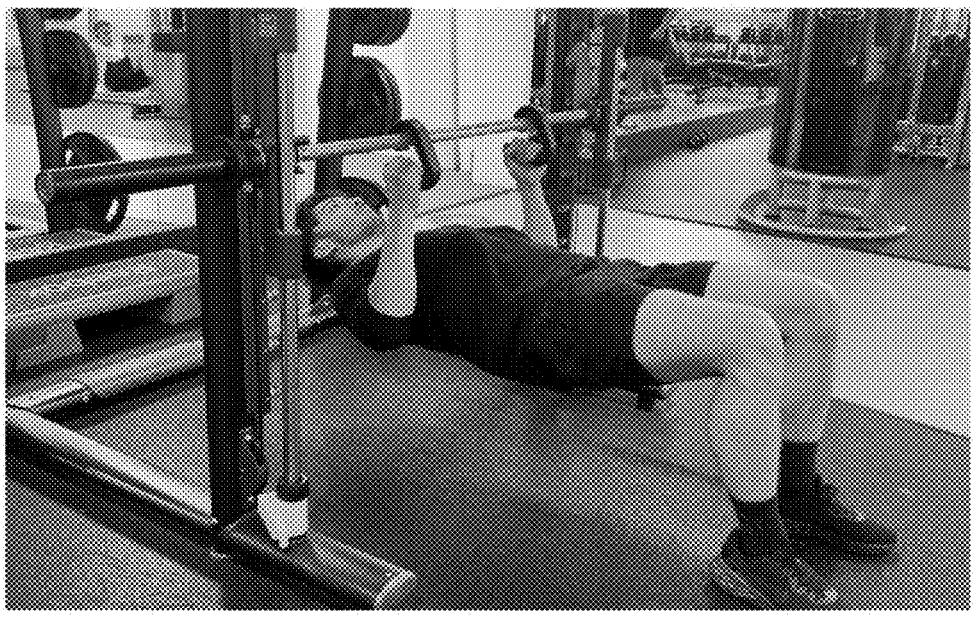
FIG. 15 shows a user performing an inverted row exercise with a neutral grip, by holding a pair of gripper devices of the present invention gripping a Smith bar.

FIG. 13 illustrates a pair of gripper devices of the present invention gripping a pull-up bar. FIG. 14 illustrates a user performing a pull-up exercise in a neutral grip by holding the gripper devices gripping the pull-up bar;

FIG. 15 shows a user performing an inverted row exercise with a neutral grip, by holding a pair of gripper devices of the present invention gripping a Smith bar.

Figure 16:
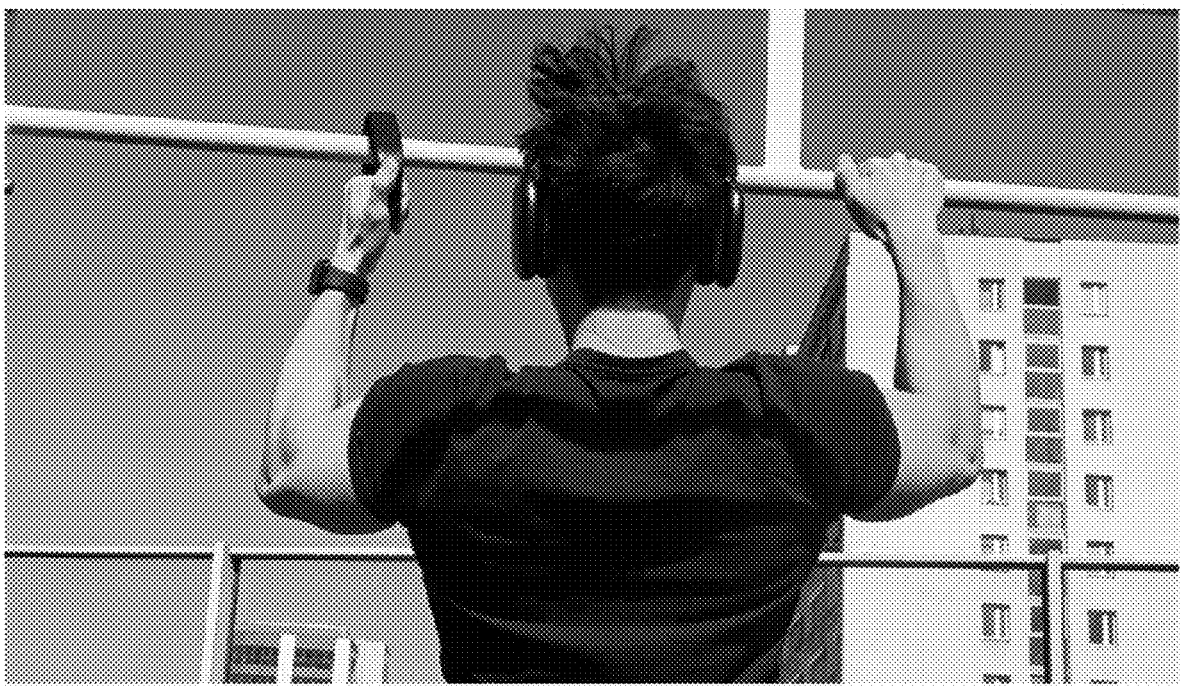
FIG. 16 shows a user performing a lat pull down exercise with a neutral grip, by holding a gripper device of the present invention gripping the pull bar.

FIG. 16 shows a user performing a lat pull down exercise with a neutral grip, by holding a gripper device of the present invention gripping the pull bar.

Figure 17:
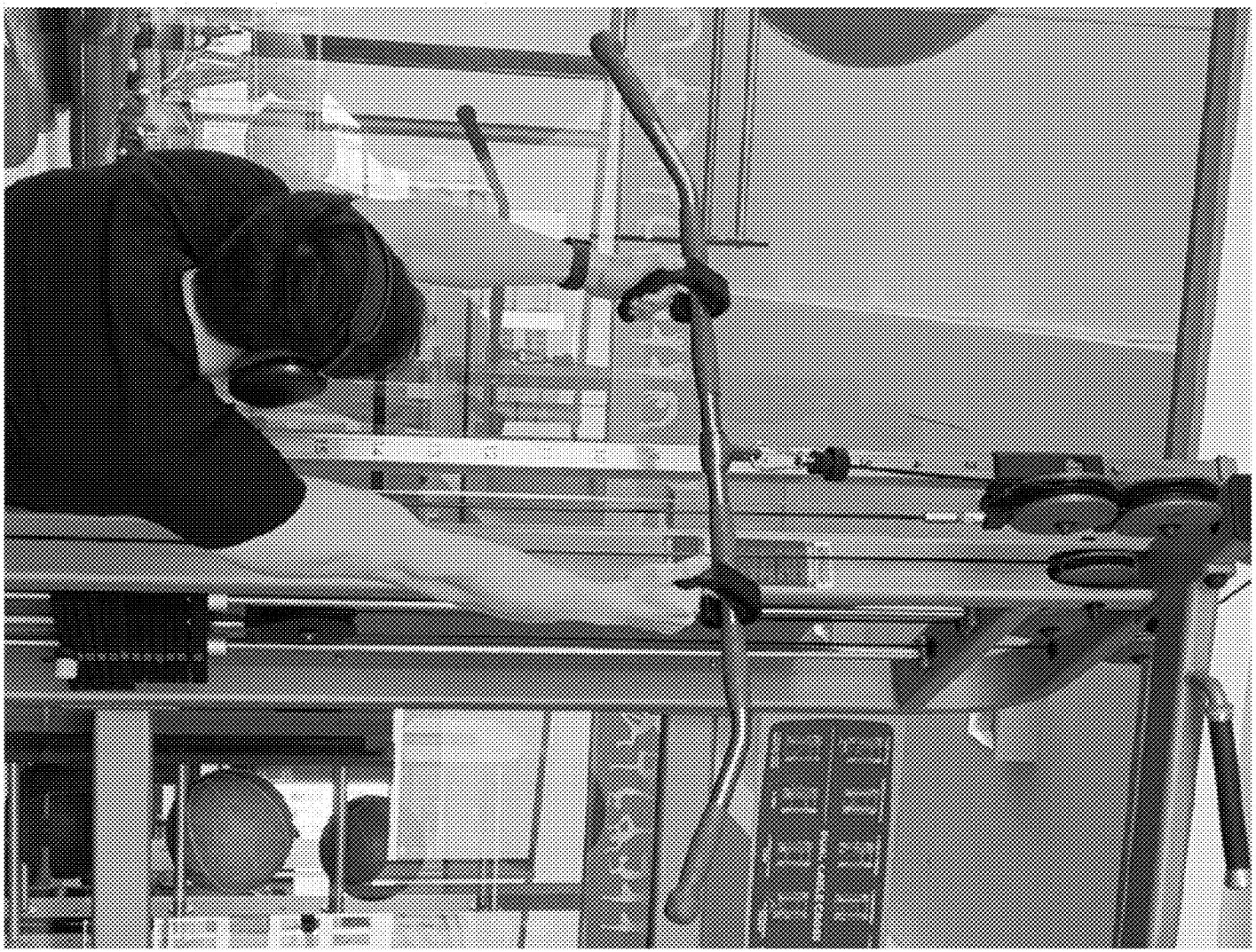
FIG. 17 shows a user performing an uneven pullup with a neutral grip, by holding a pair of gripper devices of the present invention gripping an uneven pull-up bar.

FIG. 17 shows a user performing an uneven pullup with a neutral grip, by holding a pair of gripper devices of the present invention gripping an uneven pull-up bar.

What is claimed is:

1. A gripper device for gripping a bar, the gripper device comprising:

a hook having a shank and a bend, the shank having a first starting edge and a first ending edge and the bend having a second starting edge and a second ending edge, such that the first ending edge of the shank corresponds to the second starting edge of the bend and the second ending edge of the bend is a free end, the hook having a first inner surface extending around a first axis and facing the first axis and a first outer surface facing away from the first axis, the inner surface of the hook being shaped to partially extend around a bar parallel to the first axis to grip the bar;

a protective layer coating the inner surface of the hook and configured to contact the bar when the hook grips the bar;

a handle joined to the hook at the first starting edge of the shank, such that the handle extends along a second axis located at a predetermined distance from the first axis and being at a first angle with the first axis, wherein the first axis is located between the hook and the handle;

wherein the first angle between the second axis and the first axis is larger than 0 degrees and smaller than or equal to about 90 degrees.

2. The gripper device of claim 1, wherein the protective layer is elastic.

3. The gripper device of claim 1, comprising a removable attachment having a hook shape and having a second inner surface and a second outer surface, the removable attachment being removably joinable to the first inner surface of the hook, wherein:

the second outer surface is configured to face the first inner surface to hook; and the second inner surface curves around a third axis at a second angle with the first axis and is configured to partially curve around a bar parallel to the third axis and grip the bar, such that the third axis is at a third angle with the second axis different than the first angle between the first axis and the second axis.

4. The gripper device of claim 1, wherein the handle is joined to the hook via a connective portion located between the hook and the handle.

5. The gripper device of claim 4, wherein the connective portion and the hook are rotatable with respect to each other and are configured to be lockable at a plurality of orientations with respect to each other, such that the first angle between the first axis and the second axis is adjustable.

6. The gripper device of claim 5, comprising:

a first rim extending from the connective portion, the first rim having a plurality of first openings disposed around the first rim;

a second rim extending from the hook and having second openings disposed around the second rim;

a pin configured to fit into the first openings and the second openings;

wherein the first rim is configured to fit within the second rim, or the second rim is configured to fit within the first rim, such that at least two of the first openings are aligned with two of the second openings at at least two different orientations, such that the pin is configured to traverse a first pair of openings and a second pair of openings, the first pair comprising one of the first openings and one of the second openings aligned therewith, and the second pair comprising a different one of the first openings and a different on of the second openings aligned therewith.

7. The gripper device of claim 6, wherein:

the first rim and the second rim are cylindrical;

the first openings are disposed circumferentially on a curved surface of the first rim; and the second openings are disposed circumferentially on a curved surface of the second rim.

8. The gripper device of claim 1, wherein the inner surface of the hook is shaped as a portion of a triangle to partially extend around the bar parallel to the first axis and grip the bar.

9. A kit of a pair of gripper devices for gripping a bar, the kit comprising a first gripper device and a second gripper device, wherein:

each of the gripper devices, comprises:

a hook a hook having a shank and a bend, the shank having a first starting edge and a first ending edge and the bend having a second starting edge and a second ending edge, such that the first ending edge of the shank corresponds to the second starting edge of the bend and the second ending edge of the bend is a free end, the hook having a first inner surface extending around a first axis and facing the first axis and a first outer surface facing away from the first axis, the first inner surface of the hook being shaped to partially extend around a bar parallel to the first axis to grip the bar;

a protective layer coating the first inner surface of the hook and configured to contact the bar when the hook grips the bar;

a handle joined to the hook at the first starting edge of the shank, such that the first handle extends along a second axis located at a predetermined distance from the first axis and being at a first angle with the first axis, wherein the first axis is located between the hook and the handle;

wherein the first angles are larger than 0 degrees and smaller than or equal to about 90 degrees.

10. The kit of claim 9, wherein the handles of the gripper devices are symmetrical to each other with respect to a central plane perpendicular to a common axis aligned with the first axis of each gripper device.

11. The kit of claim 9, comprising two removable attachments, each having hook shape and having a second inner surface and a second outer surface, each removable attachment being removably joinable to the first inner surface of a respective hook, wherein:

each second outer surface is configured to face the first inner surface to hook; and each second inner surface curves around a respective third axis at a second angle with the first axis and is configured to partially curve around a bar parallel to the third axis and grip the bar, such that the third axis is at a third angle with the second axis different than the first angle between the first axis and the second axis.

12. The kit of claim 9, wherein each protective layer is elastic.

13. The kit of claim 9, wherein:

each handle is joined to the respective hook via a respective connective portion located between the hook and the handle.

14. The kit of claim 9, wherein, for each gripper device, the inner surface of the hook is shaped as a portion of a triangle to partially extend around the bar parallel to the first axis and grip the bar.

15. A gripper device for gripping a bar, the gripper device comprising:

a hook having a shank and a bend, the shank having a first starting edge and a first ending edge and the bend having a second starting edge and a second ending edge, such that the first ending edge of the shank corresponds to the second starting edge of the bend and the second ending edge of the bend is a free end, the hook having a first inner surface extending around a first axis and facing the first axis and a first outer surface facing away from the first axis, the inner surface of the hook being shaped to partially extend around a bar parallel to the first axis to grip the bar;

a protective layer coating the inner surface of the hook and configured to contact the bar when the hook grips the bar;

a handle joined to the hook at the first starting edge of the shank, such that the handle extends along a second axis located at a predetermined distance from the first axis and being at a first angle with the first axis, wherein the first axis is located between the hook and the handle;

a removable attachment having a hook shape and having a second inner surface and a second outer surface, the removable attachment being removably joinable to the first inner surface of the hook, wherein:

the second outer surface is configured to face the first inner surface to hook; and the second inner surface curves around a third axis at a second angle with the first axis and is configured to partially curve around a bar parallel to the third axis and grip the bar, such that the third axis is at a third angle with the second axis different than the first angle between the first axis and the second axis.

16. A gripper device for gripping a bar, the gripper device comprising:

a hook having a shank and a bend, the shank having a first starting edge and a first ending edge and the bend having a second starting edge and a second ending edge, such that the first ending edge of the shank corresponds to the second starting edge of the bend and the second ending edge of the bend is a free end, the hook having a first inner surface extending around a first axis and facing the first axis and a first outer surface facing away from the first axis, the inner surface of the hook being shaped to partially extend around a bar parallel to the first axis to grip the bar;

a protective layer coating the inner surface of the hook and configured to contact the bar when the hook grips the bar;

a handle joined to the hook at the first starting edge of the shank, such that the handle extends along a second axis located at a predetermined distance from the first axis and being at a first angle with the first axis, wherein the first axis is located between the hook and the handle;

wherein the handle is joined to the hook via a connective portion located between the hook and the handle;

wherein the connective portion and the hook are rotatable with respect to each other and are configured to be lockable at a plurality of orientations with respect to each other, such that the first angle between the first axis and the second axis is adjustable.

17. A gripper device for gripping a bar, the gripper device comprising:

a hook having a shank and a bend, the shank having a first starting edge and a first ending edge and the bend having a second starting edge and a second ending edge, such that the first ending edge of the shank corresponds to the second starting edge of the bend and the second ending edge of the bend is a free end, the hook having a first inner surface extending around a first axis and facing the first axis and a first outer surface facing away from the first axis, the inner surface of the hook being shaped to partially extend around a bar parallel to the first axis to grip the bar;

a protective layer coating the inner surface of the hook and configured to contact the bar when the hook grips the bar;

a handle joined to the hook at the first starting edge of the shank, such that the handle extends along a second axis located at a predetermined distance from the first axis and being at a first angle with the first axis, wherein the first axis is located between the hook and the handle;

wherein:

the handle extends between a first end and a second free end;

the first end of the handle is joined to the first starting edge of the shank of the hook;

a gap is present between the second free end of the handle and the second ending edge of the bend;

the first angle between the first axis and the handle is a non-perpendicular angle.

18. A kit of a pair of gripper devices for gripping a bar, the kit comprising a first gripper device and a second gripper device, wherein:

each of the gripper devices, comprises:

a hook having a shank and a bend, the shank having a first starting edge and a first ending edge and the bend having a second starting edge and a second ending edge, such that the first ending edge of the shank corresponds to the second starting edge of the bend and the second ending edge of the bend is a free end, the hook having a first inner surface extending around a first axis and facing the first axis and a first outer surface facing away from the first axis, the first inner surface of the hook being shaped to partially extend around a bar parallel to the first axis to grip the bar;

a protective layer coating the first inner surface of the hook and configured to contact the bar when the hook grips the bar;

a handle joined to the hook at the first starting edge of the shank, such that the first handle extends along a second axis located at a predetermined distance from the first axis and being at a first angle with the first axis, wherein the first axis is located between the hook and the handle;

wherein, for each gripper device:

the handle extends between a first end and a second free end;

the first end of the handle is joined to the first starting edge of the shank of the hook;

a gap is present between the second free end of the handle and the second ending edge of the bend;

the first angle between the first axis and the handle is a non-perpendicular angle.

* * * * *